US007150370B2

(12) United States Patent
Pyun

(10) Patent No.: US 7,150,370 B2
(45) Date of Patent: Dec. 19, 2006

(54) AIR VENTING APPARATUS FOR MILK BOTTLE

(76) Inventor: Sung-Hwan Pyun, Samjeong-dong, Ojeong-gu, Bucheon-si, Gyeonggi-do (KR)

( * ) Notice: Subject to any disclaimer, the term of this patent is extended or adjusted under 35 U.S.C. 154(b) by 324 days.

(21) Appl. No.: 10/687,071

(22) Filed: Oct. 16, 2003

(65) Prior Publication Data

US 2004/0089626 A1 May 13, 2004

(30) Foreign Application Priority Data

Oct. 21, 2002 (KR) ..... 10-2002-0064270
Aug. 29, 2003 (KR) ..... 10-2003-0060185

(51) Int. Cl.
*A61J 9/04* (2006.01)
*A61J 11/02* (2006.01)

(52) U.S. Cl. ..... 215/11.5; 215/11.1; 215/11.4; 220/714

(58) Field of Classification Search ..... 215/11.1, 215/11.5, 388, 902, 307, 311; 220/714, DIG. 27, 220/203.11, 203.17
See application file for complete search history.

(56) References Cited

U.S. PATENT DOCUMENTS 380,835 A * 4/1888 Ware ..... 215/11.5
2,061,477 A * 11/1936 Perry ..... 215/11.5
2,321,236 A * 6/1943 Parkin ..... 137/860
2,365,585 A * 12/1944 Paxman ..... 215/11.1
2,616,581 A * 11/1952 Madsen et al. ..... 215/11.5
2,744,646 A * 5/1956 Blackstone ..... 215/11.1
3,411,648 A * 11/1968 Tichy ..... 215/11.4
5,678,710 A * 10/1997 Sheu ..... 215/11.5
5,863,126 A * 1/1999 Guild ..... 366/130
6,041,951 A * 3/2000 Blum et al. ..... 215/11.1
6,068,147 A * 5/2000 Sheu ..... 215/11.5
6,499,615 B1 * 12/2002 Szieff et al. ..... 215/11.5
2003/0183595 A1 * 10/2003 Huang ..... 215/11.5

* cited by examiner

*Primary Examiner*—Sue A. Weaver
(74) *Attorney, Agent, or Firm*—Cha & Reiter, L.L.C.

(57) ABSTRACT

An air venting apparatus for a milk bottle having a soft teat for a baby to suck, a bottle for containing milk, and a fixing frame for fixing the soft teat to the bottle without leakage. In the air venting apparatus, an upper plate is disposed between the top of a body of the bottle and the base of the teat and has at least one air inlet groove for guiding external air into the bottle body. A lower plate is combined with the upper plate and has at least one thorough hole and an air control valve to control the amount of the introduced air and discharges a gas generated from high-temperature milk outside the bottle body. An annular connection member is combined with the lower plate and provides the amount-controlled air into the bottle body.

3 Claims, 26 Drawing Sheets

AIR VENTING APPARATUS FOR MILK BOTTLE

PRIORITY

This application claims priorities under 35 U.S.C. § 119 to an application entitled "Milk Bottle for Baby with Air Venting Path" filed in the Korean Intellectual Property Office on Oct. 21, 2002 and assigned Ser. No. 2002-64270 and to an application entitled "Air Venting Apparatus for Milk Bottle" filed in the Korean Intellectual Property Office on Aug. 29, 2003 and assigned Ser. No. 2003-60185, the contents of which are incorporated herein by reference.

BACKGROUND OF THE INVENTION

1. Field of the Invention

The present invention relates generally to a milk bottle for a baby, and in particular, to a milk bottle having an air vent path and thus convenient to use for a baby.

2. Description of the Related Art

In general, the teat of a milk bottle for a baby is made of a soft, harmless material and has a very small hole at its tip. Thus, a baby instinctively sucks milk or baby beverage from the teat. Even when the milk bottle is shaken or dropped hard, the milk should not spurt out from the hole of the teat. According to the strength of baby suck, an appropriate amount of the milk should flow. Thus, the teat should allow neither too a large amount of milk nor too a small mount of milk. It should adjust milk flow to suit a baby's suck. Appropriate milk flow is a primary consideration to the design of a baby milk bottle. In this regard, various apparatuses will be developed for a baby bottle for milk. The milk bottle must be designed to be completely leakproof at the base of the teat. To prevent milk leakage when mixing milk powder and water at a predetermined ratio and shaking them, a variety of devices have been proposed.

A conventional technological solution for a leakproof milk bottle is disclosed in U.S. Pat. No. 6,112,919 entitled "Leakage Preventing Device for Milk Bottle or the Like".

Although the leakproof milk bottle completely prevents milk leakage, technical solutions to the following considerations are yet to be presented. It should be made sure that a milk bottle is perfectly leakproof, uniformly mixes milk powder and water when shaken, and adjusts milk flow to baby suction. While babies have different strengths of suck, it is important to provide smooth milk flow to the babies according to their suction. The above milk bottle has the distinctive shortcoming that air bubbles are formed while mixing milk powder and water at an appropriate ratio. These air bubbles destroy nutrients. Accordingly, air bubbles must be suppressed during mixing milk powder and water. The milk bottle in the above patent offers the benefit of complete milk leakage prevention, but does not satisfy all technical needs to baby milk bottles.

SUMMARY OF THE INVENTION

It is, therefore, an object of the present invention to provide an air venting apparatus for a baby milk bottle, which provides an air vent path to introduce air inside the milk bottle, allows an appropriate flow of milk or baby beverage, and suppresses formation of air bubbles to thereby minimize destruction of nutrients.

It is another object of the present invention to provide an air venting apparatus for a baby milk bottle having a mixing apparatus for mixing milk powder and water uniformly.

The above objects are achieved by an air venting apparatus for a milk bottle having a soft teat for a baby to suck, a bottle for containing milk, and a fixing frame for fixing the soft teat to the bottle without leakage.

According to one aspect of the present invention, in the air venting apparatus, an upper plate is disposed between the top of a body of the bottle and the base of the teat and has at least one air inlet groove for guiding external air into the bottle body. A lower plate is combined with the upper plate and has at least one thorough hole and an air control valve to control the amount of the introduced air and discharges a gas generated from high-temperature milk outside the bottle body. An annular connection member is combined with the lower plate and provides the amount-controlled air into the bottle body.

According to another aspect of the present invention, in the air venting apparatus, an air vent valve is disposed between the top of a body of the bottle and the base of the teat and has an one air inlet groove on the upper surface for guiding external air into the bottle body and an air control valve on the lower surface to control the amount of air introduced through the air inlet groove and discharge a gas generated from high-temperature milk outside the bottle body. An annular connection member is combined with the air control valve, and provides the controlled air into the bottle body.

According to a further aspect of the present invention, in the air venting apparatus, an air vent valve extends downward from a predetermined position of the bottom of the teat and has a hole for communicating external air with the inside of the bottle, a second hole under the first hole, for receiving the air from the first hole, and a valve convex downward under the second hole. An annular connection member extends from the air vent valve to the vicinity of the bottom of the bottle and provides the controlled air toward the bottom of the bottle.

According to still another aspect of the present invention, in the air venting apparatus, an air vent valve extends downward from a predetermined position of the bottom of the teat and has a hole for communicating external air with the inside of the bottle, a second hole under the first hole, for receiving the air from the first hole, and a valve convex downward under the second hole. A fixing member is combined with the base of the teat and has a third hole. An annular connection member is combined with the fixing member and extending from the third hole to the vicinity of the bottom of the bottle, thus defining a milk suction path into the teat.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will be described herein below with reference to the accompanying drawings. In the following description, well-known functions or constructions are not described in detail since they would obscure the invention in unnecessary detail.

With reference to FIGS. 1 to 11, the operation of an air venting apparatus for a baby milk bottle according to an embodiment of the present invention will be described below in detail.

Figure 1:
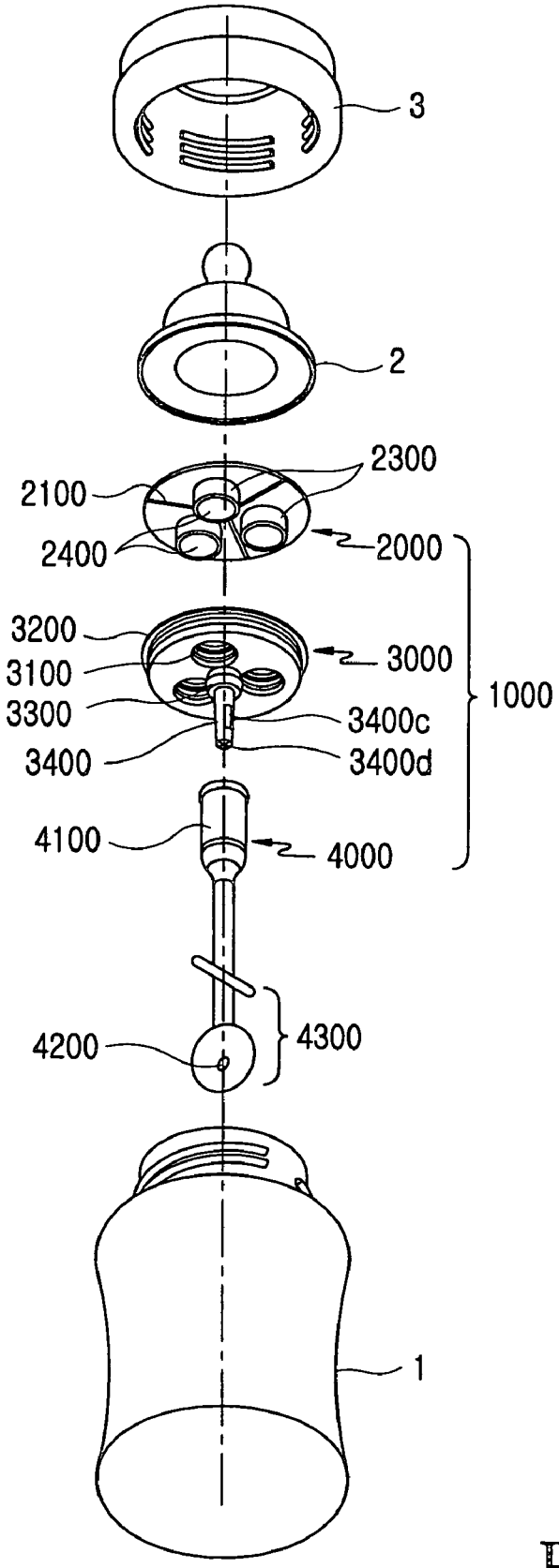
FIG. 1 is an exploded perspective view of an air venting apparatus for a baby milk bottle according to an embodiment of the present invention.
Figure 2:
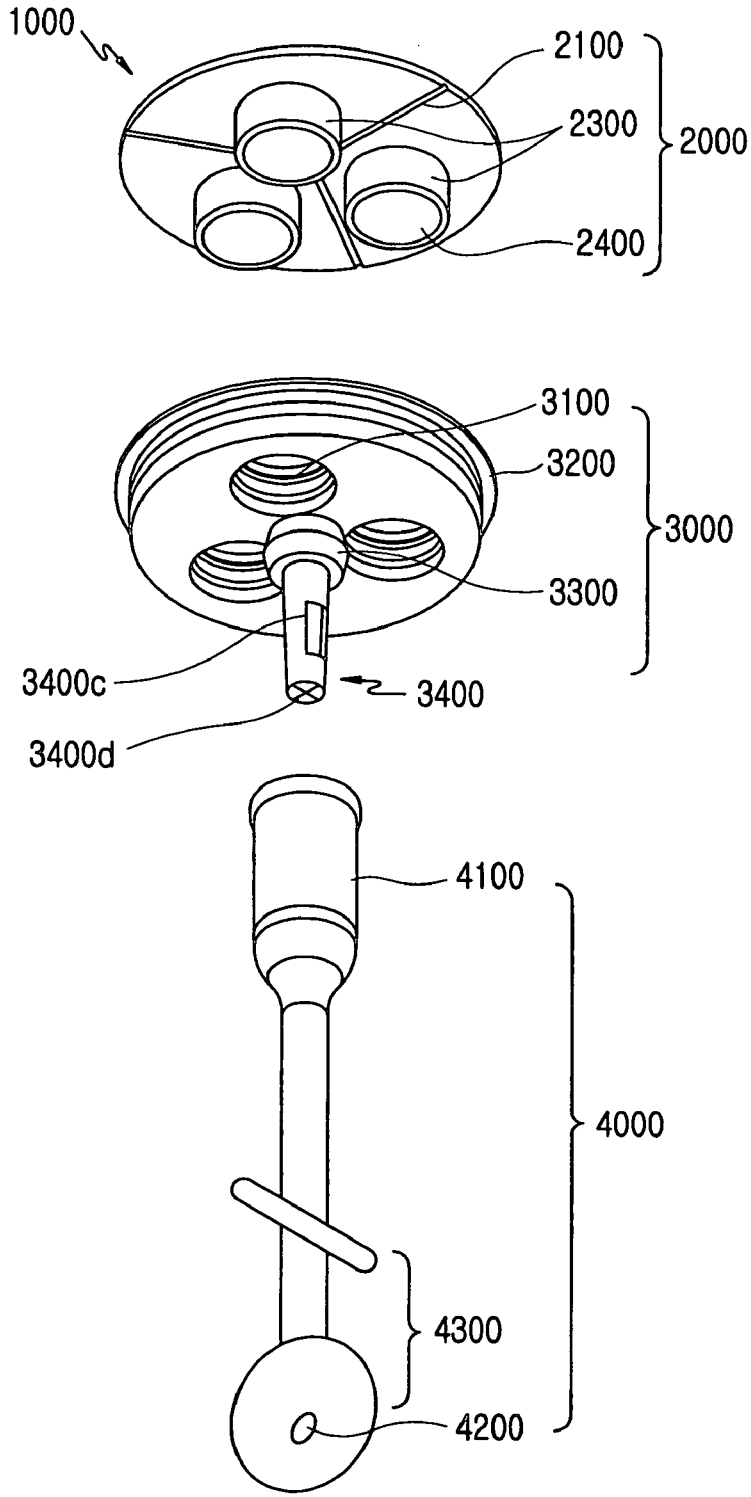
FIG. 2 is an exploded perspective view of the air venting apparatus before assembly according to the embodiment of the present invention.
Figure 3:
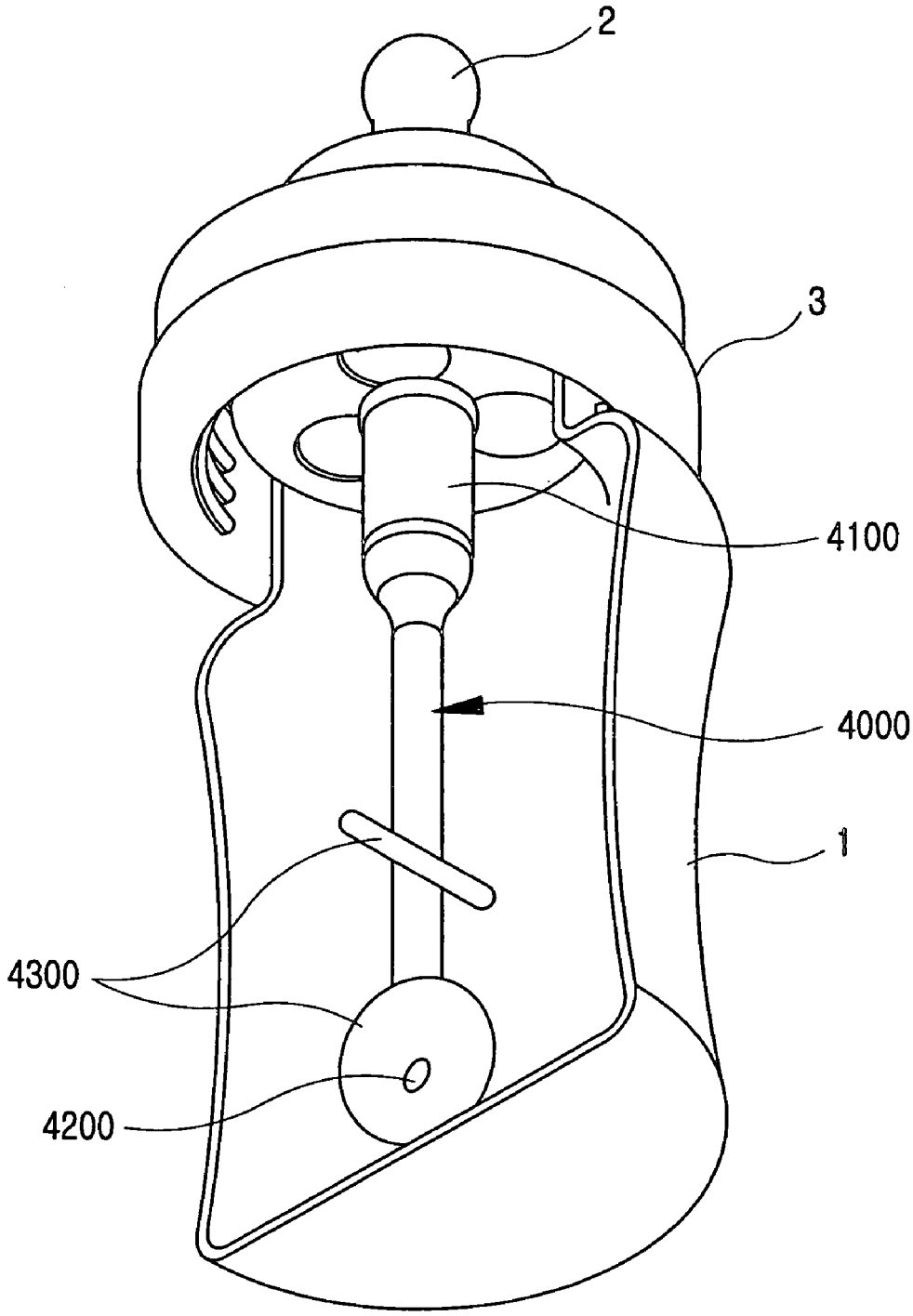
FIG. 3 is a sectional perspective view of the air venting apparatus assembled in the baby milk bottle according to the embodiment of the present invention.

Referring to FIGS. 1 and 2, the milk bottle includes a bottle body 1 for filling milk therein, a soft teat 2 on top of the bottle body 1, for a baby to suck milk from, and a fixing frame 3 for fixing the soft teat 2 to the bottle to prevent milk leakage. After milk powder and water are poured in the bottle body 1, an air venting apparatus 1000 is engaged between the top of the bottle body 1 and the base of the soft teat 2.

As illustrated in FIG. 2, the air venting apparatus 1000 is comprised of an upper plate 2000, a lower plate 3000, and an annular connection member 4000. The annular connection member 4000 is engaged with the lower end of the lower plate 3000. The lower plate 3000 is then inserted into the bottle body 1. In this state, the teat 2 is mounted on the air venting apparatus 1000 and the fixing frame 3 is screwed down to seal the bottle body 1 together with the air venting apparatus 1000 and the teat 2. Since the fixing frame 3 and the top of the bottle body 1 have discontinuous screw threads, air vent paths 3*a* are formed in areas free of the screw threads, for allowing air intake. Air is introduced into the bottle along at least one air inlet groove 2100 formed in the upper plate 2000 through the air vent paths 3*a*.

Figure 4:
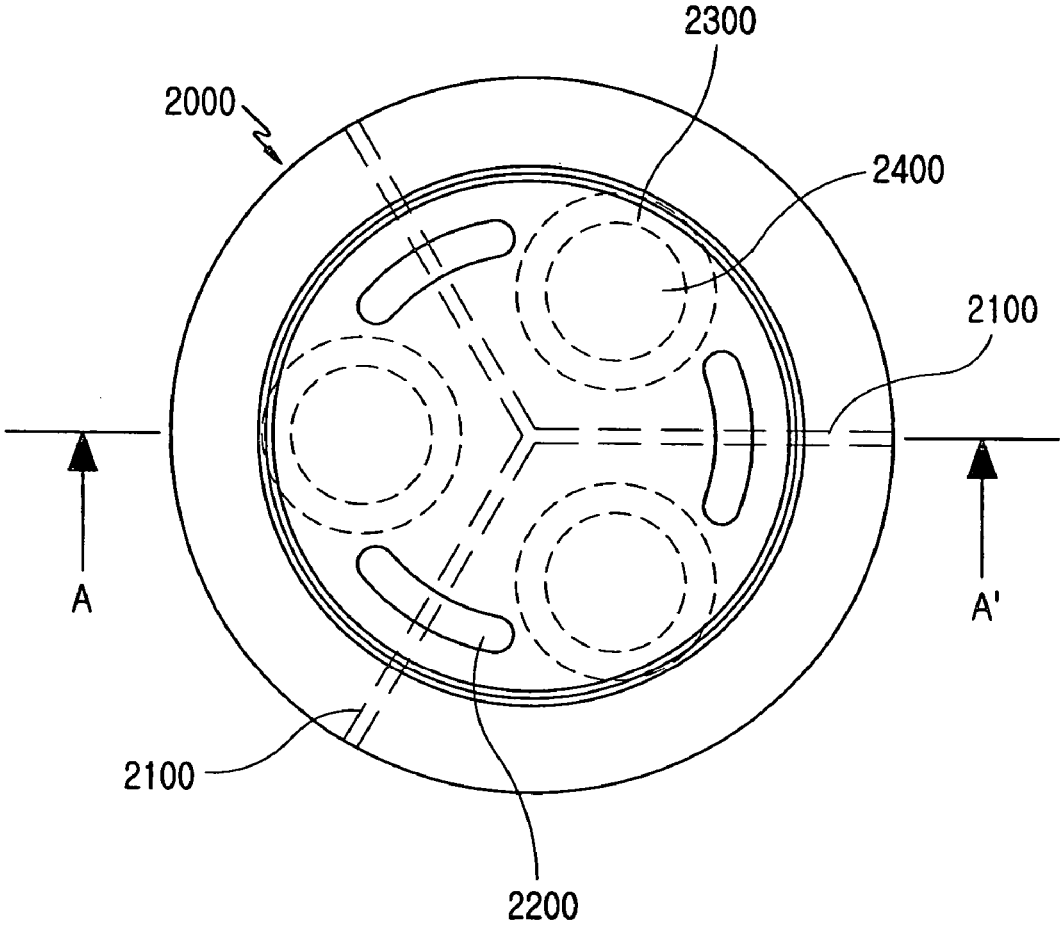
FIG. 4 is a plan view of an upper plate in the air venting apparatus for the baby milk bottle according to the embodiment of the present invention.
Figure 5:
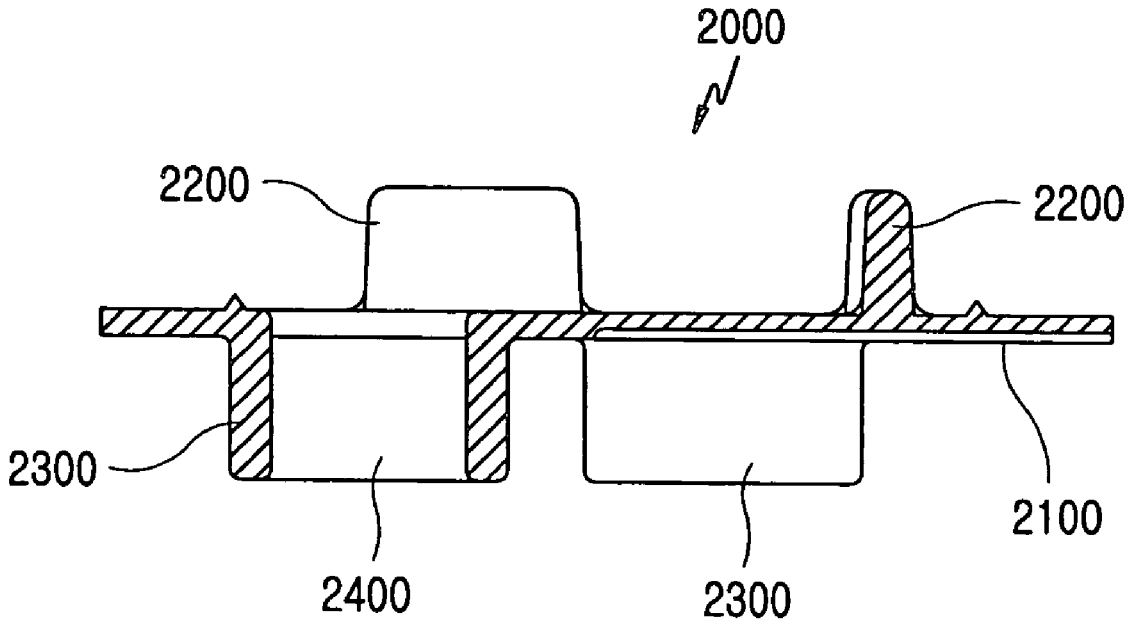
FIG. 5 is a sectional view of the upper plate illustrated in FIG. 4, taken along line A–A'.
Figure 6:
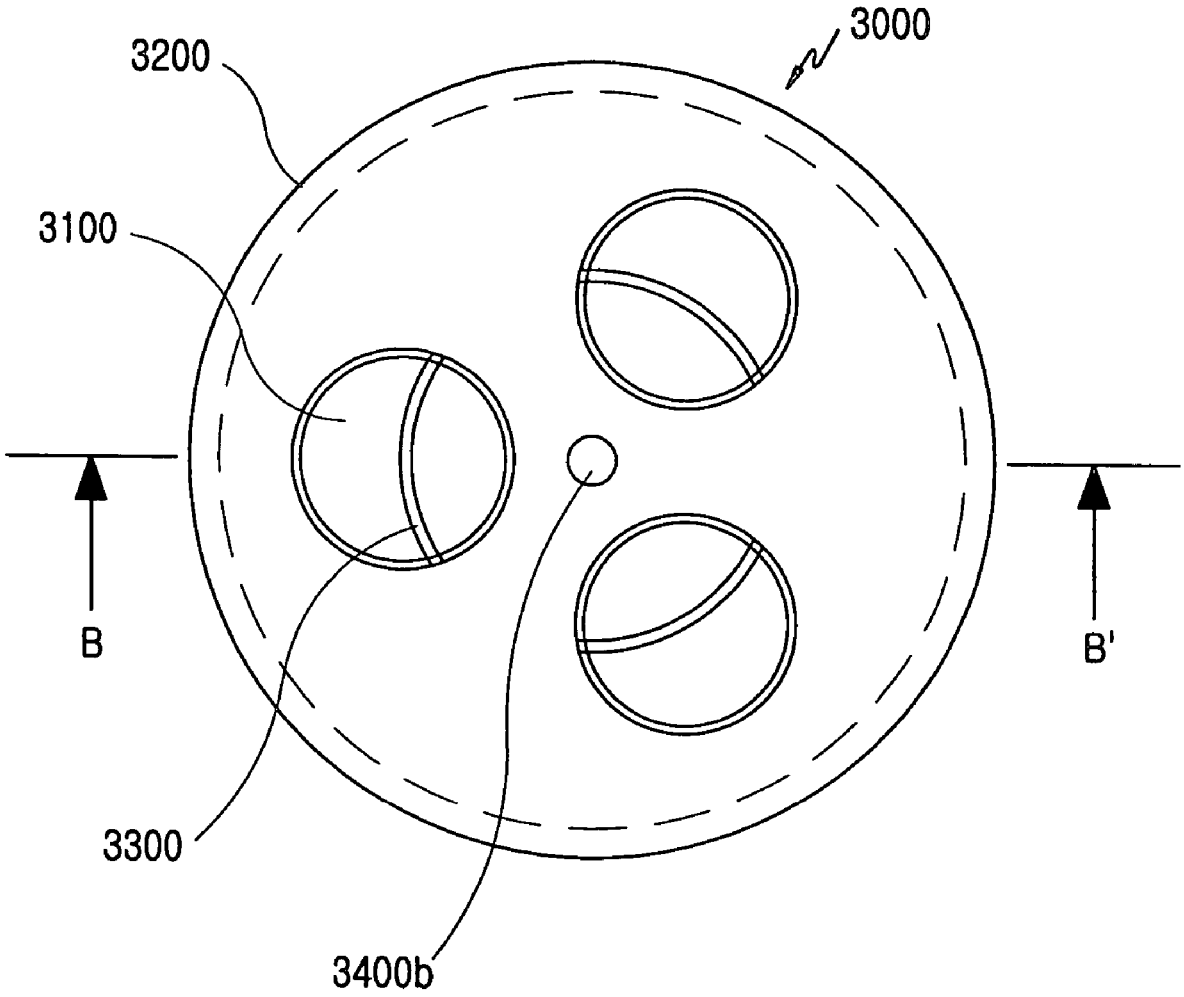
FIG. 6 is a plan view of a lower plate in the air venting apparatus for the baby milk bottle according to the embodiment of the present invention.
Figure 7:
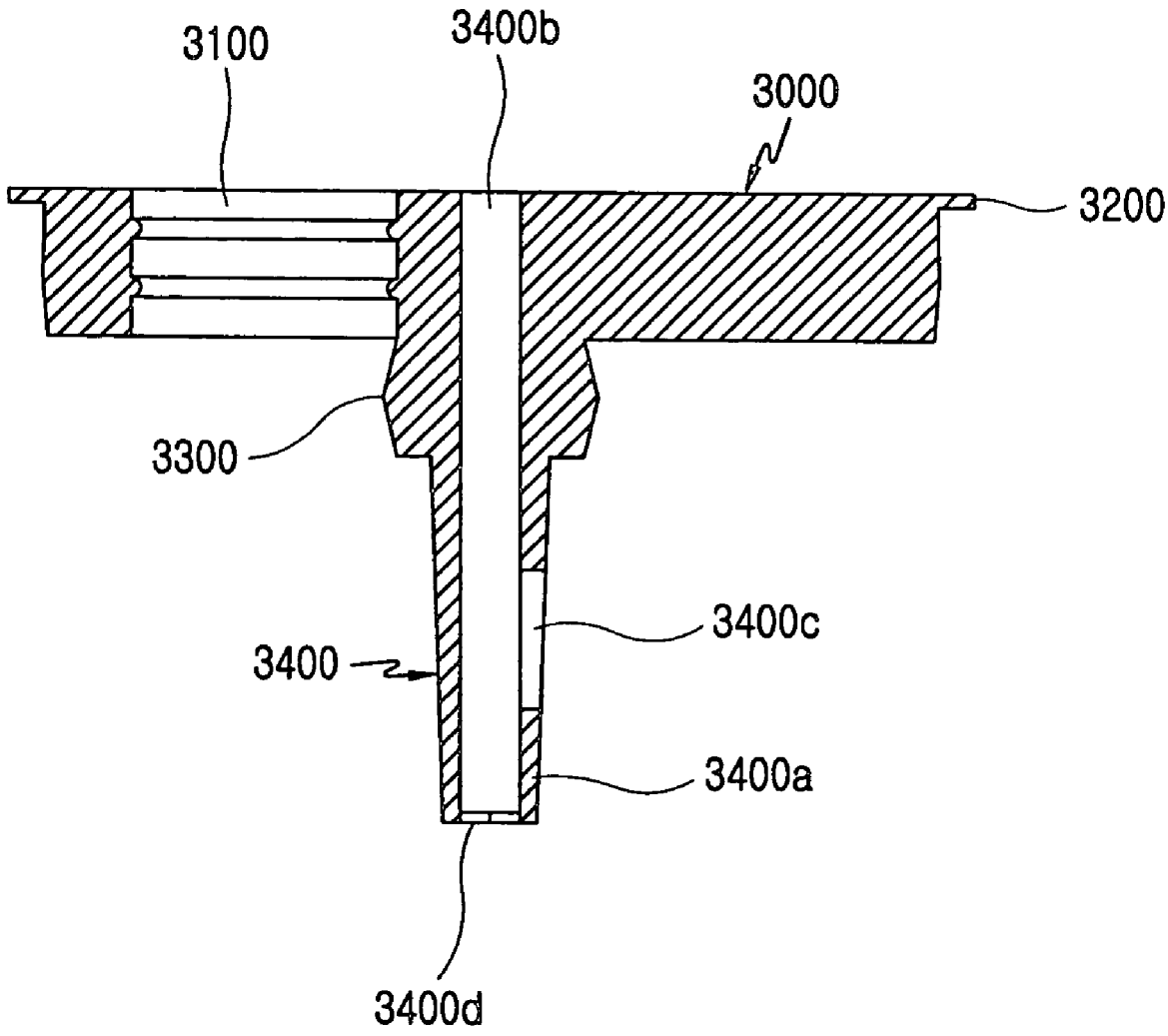
FIG. 7 is a sectional view of the lower plate illustrated in FIG. 6, taken along line B-B2'.
Figure 8:
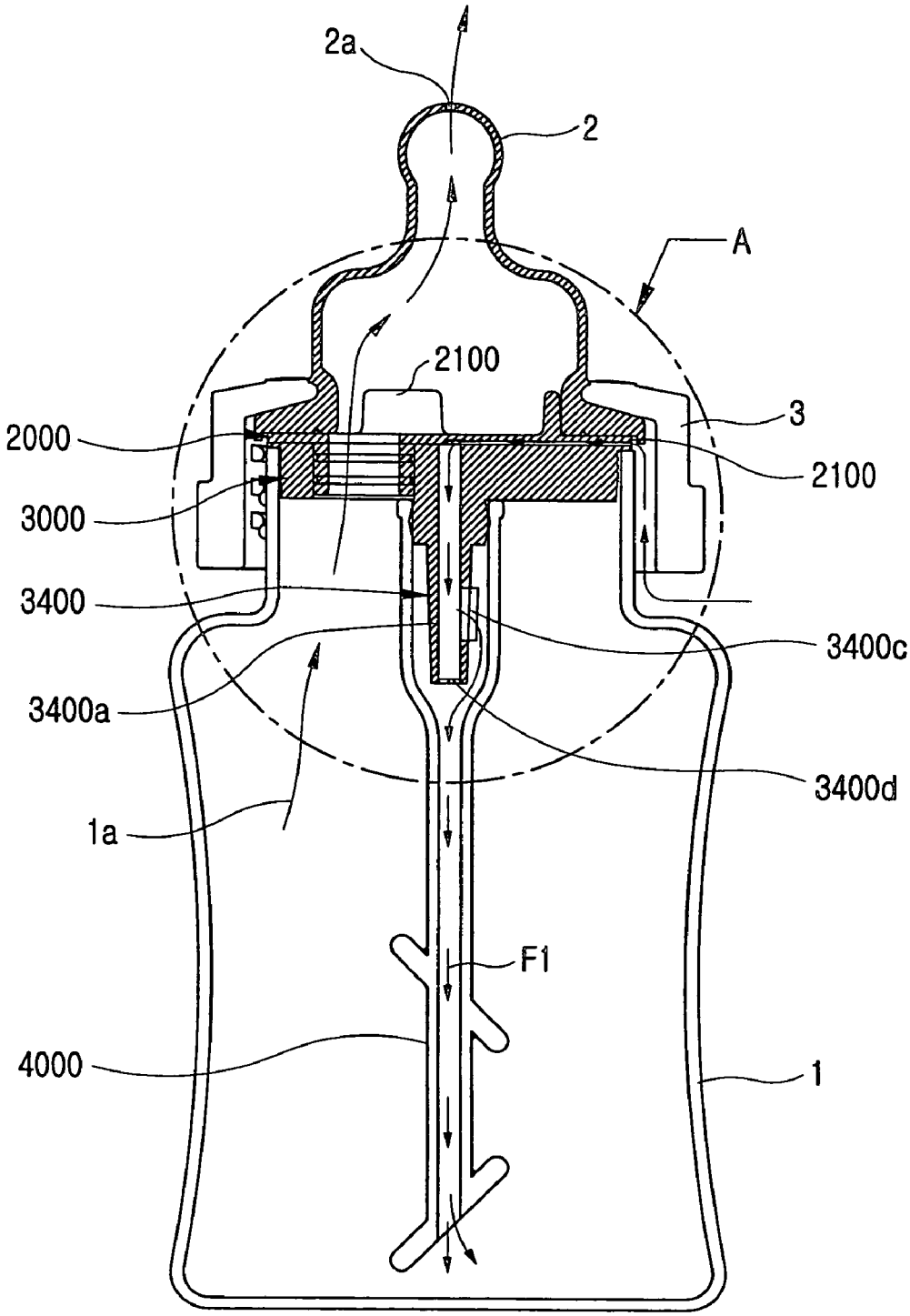
FIG. 8 is a side sectional view of the baby milk bottle incorporating the air venting apparatus with a first non-return valve opened in a air control valve according to the embodiment of the present invention.
Figure 9:
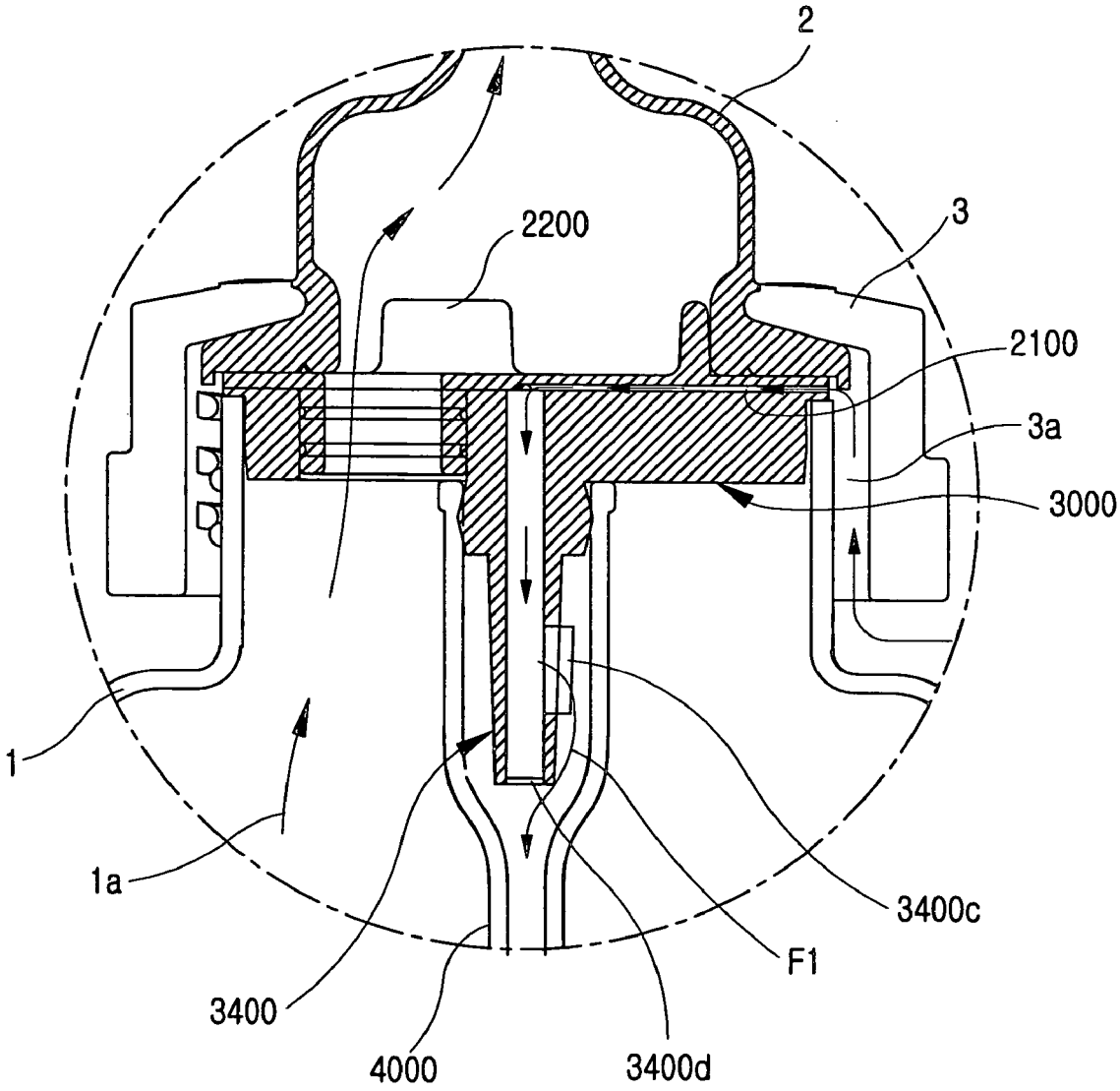
FIG. 9 is an enlarged view of a portion A in the baby milk bottle illustrated in FIG. 8.
Figure 10:
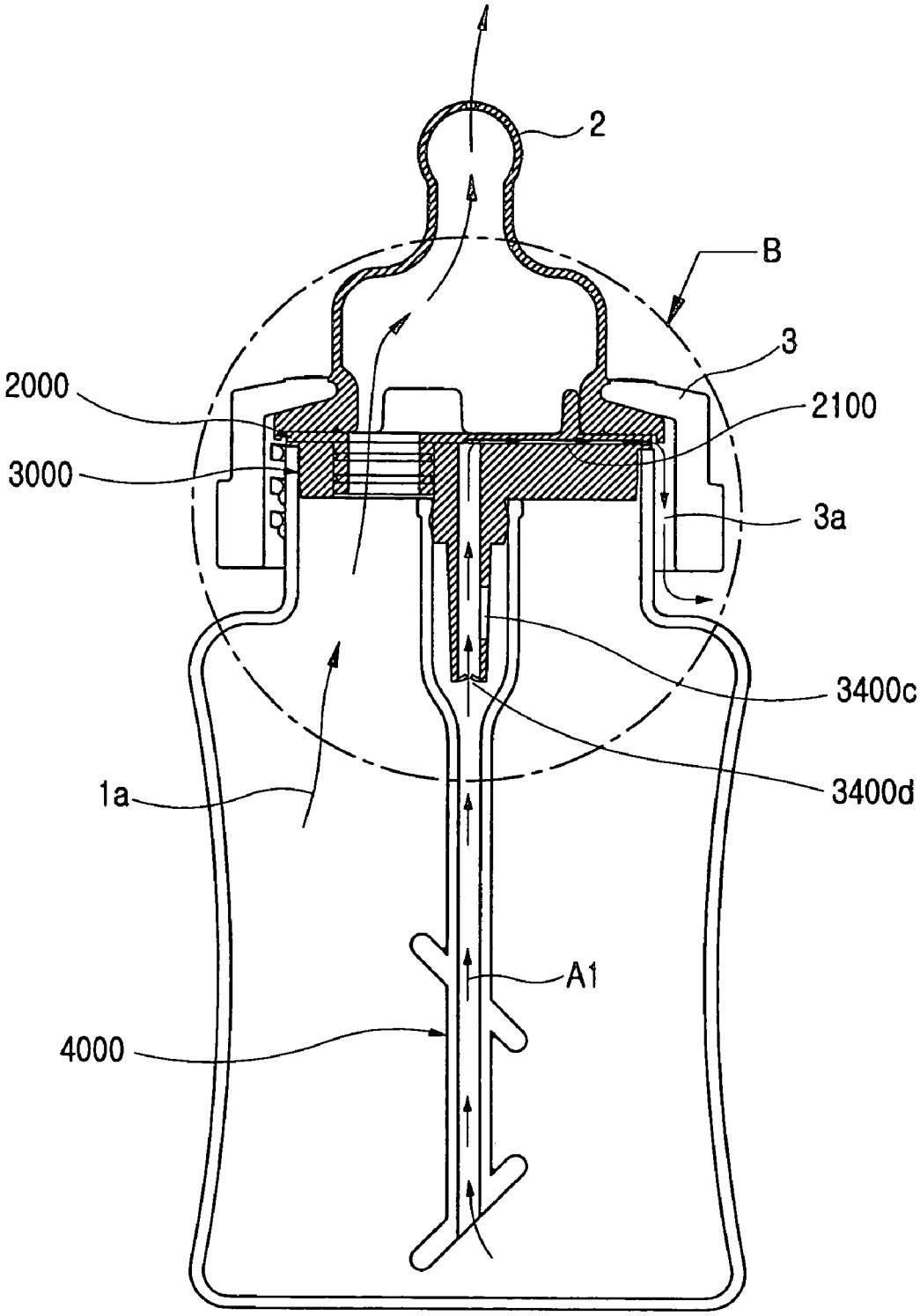
FIG. 10 is a side sectional view of the baby milk bottle incorporating the air venting apparatus with a second non-return valve opened in the air control valve according to the embodiment of the present invention.
Figure 11:
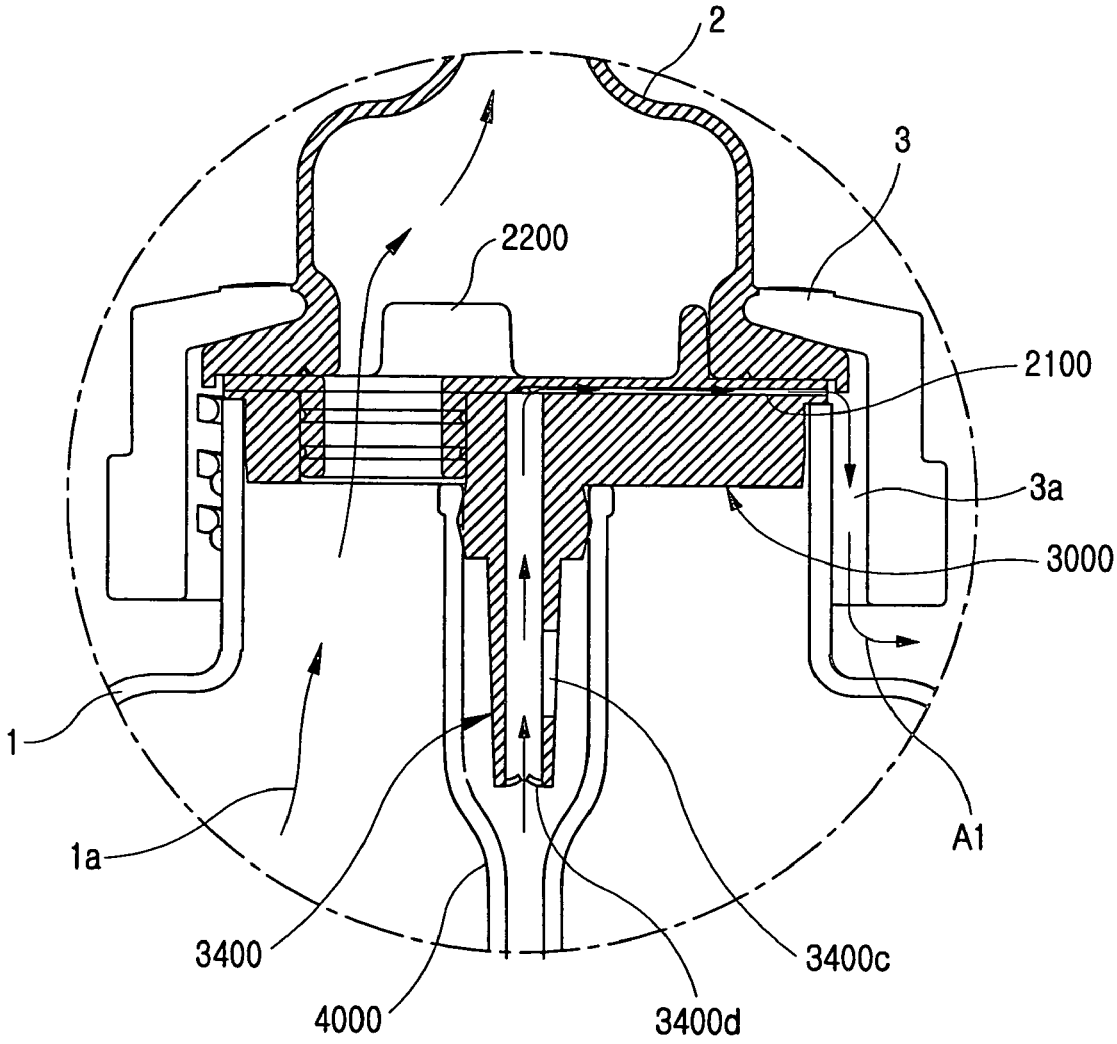
FIG. 11 is an enlarged view of a portion B in the baby milk bottle illustrated in FIG. 10.

Referring to FIGS. 4 and 5, engagement protrusions 2300 are formed on the bottom of the upper plate 2000 in correspondence with through holes 3100 formed on the lower plate 3000. The engagement protrusions 2300 are inserted into the through holes 3100. Since a sealing 3200 is formed around the side of the lower plate 3000 as illustrated in FIGS. 6 and 7, the sealing 3200 is sealed in the top of the bottle body 1. Referring to FIG. 8, a first non-return valve 3400*c* is formed in an air control valve 3400 of the lower plate 3000 in order to control air flow introduced through the air inlet grooves 2100. Referring to FIG. 9, the first non-return valve 3400*c* is formed on a side of a control valve body 3400*a* to be opened outward. Thus, the first non-return valve 3400*c* is opened outward from the control valve body 3400*a* and adjusts air flow, which was introduced into the control valve body 3400*a* along the air inlet grooves 2100, into the bottle body 1. An engagement portion 3300 is formed on the bottom of the lower plate 3000 and forcedly engaged with a cap 4100 of the annular connection member 4000. Thus, the external air controlled by the first non-return valve 3400*c* reaches inside the bottle body 1 through the annular connection member 4000. An air outlet hole 4200 is formed on a lower end of the connection member 4000, for providing the air controlled by the air control valve 3400 into the bottle body 1. To uniformly mix the milk powder and water in the bottle body 1 in this state, at least one mixer 4300 is provided. The mixer 4300 helps uniform mixing of the powder and water when the bottle body 1 is shaken left and right or up and down. During the mixing, a gas A1 is generated from high-temperature milk under the control valve body 3400*a*, as illustrated in FIG. 10. To discharge the gas A1 outside the bottle body 1, a second non-return valve 3400*d* is formed in the air control valve 3400. The second non-return valve 3400*d* is opened inward in the control valve body 3400*a* as the pressure of the gas A1 increases. Hence, the gas Al comes in the control valve body 3400*a*, passes through a hole 3400*b* formed in the upper portion of the control valve body 3400*a*, and goes out through the air inlet grooves 2100 communicating with the hole 3400*b* and the air vent paths 3*a* between the bottle body 1 and the fixing frame 3. When a baby then sucks the teat 2, the suction leads a flow of milk 1*a* into the baby's mouth through a hole 2*a* at the tip of the teat 2. The air venting apparatus 1000 introduces external air F1 into the bottle body 1, controls the amount of the air F1, mixes the air F1 with the milk 1*a* in the bottle body 1, and discharges the mixture through the hole 2*a* of the teat 2. As illustrated in FIGS. 8 and 10, the milk 1*a* moves into the teat 2 through the through holes 3100 formed in the lower plate 3000. Since a milk outlet hole 2400 is formed in the engagement protrusions 2300, the milk 1*a* moves to the teat 2 through the milk outlet hole 2400. Thus, the baby can suck the milk 1*a* out of the milk bottle comfortably and steadily.

To clean the bottle body 1 after the baby sucks up the milk 1*a*, the fixing frame 3 is turned to be loosened from the top of the bottle body 1 and removed together with the teat 2 from the bottle body 1. The air venting apparatus 1000 is also removed from the bottle body 1. The upper and lower plates 2000 and 3000 are separated from each other and the connection member 4000 is removed from the lower plate 3000. Then the separated bottle body 1, upper and lower plates 2000 and 3000, and connection member 4000 are cleaned.

With reference to FIGS. 12 to 19, the operation of an air venting apparatus for a baby milk bottle according to another embodiment of the present invention will be described in detail.

Figure 12:
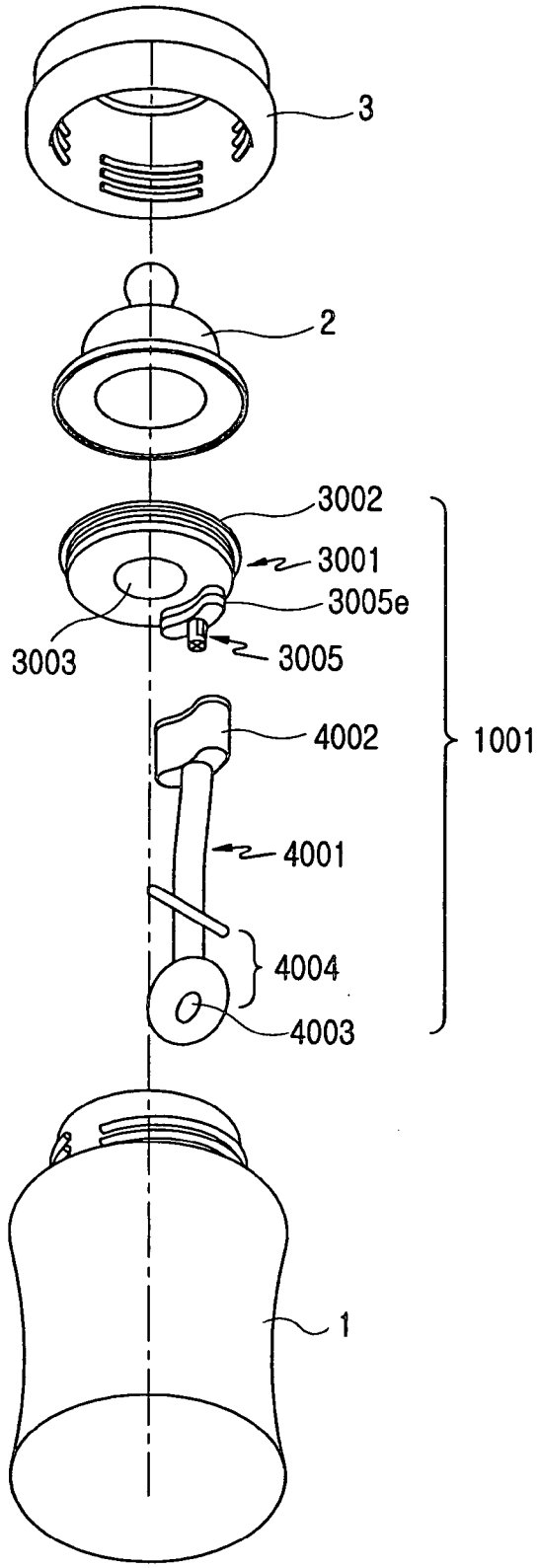
FIG. 12 is an exploded perspective view of an air venting apparatus for a baby milk bottle according to another embodiment of the present invention.
Figure 13:
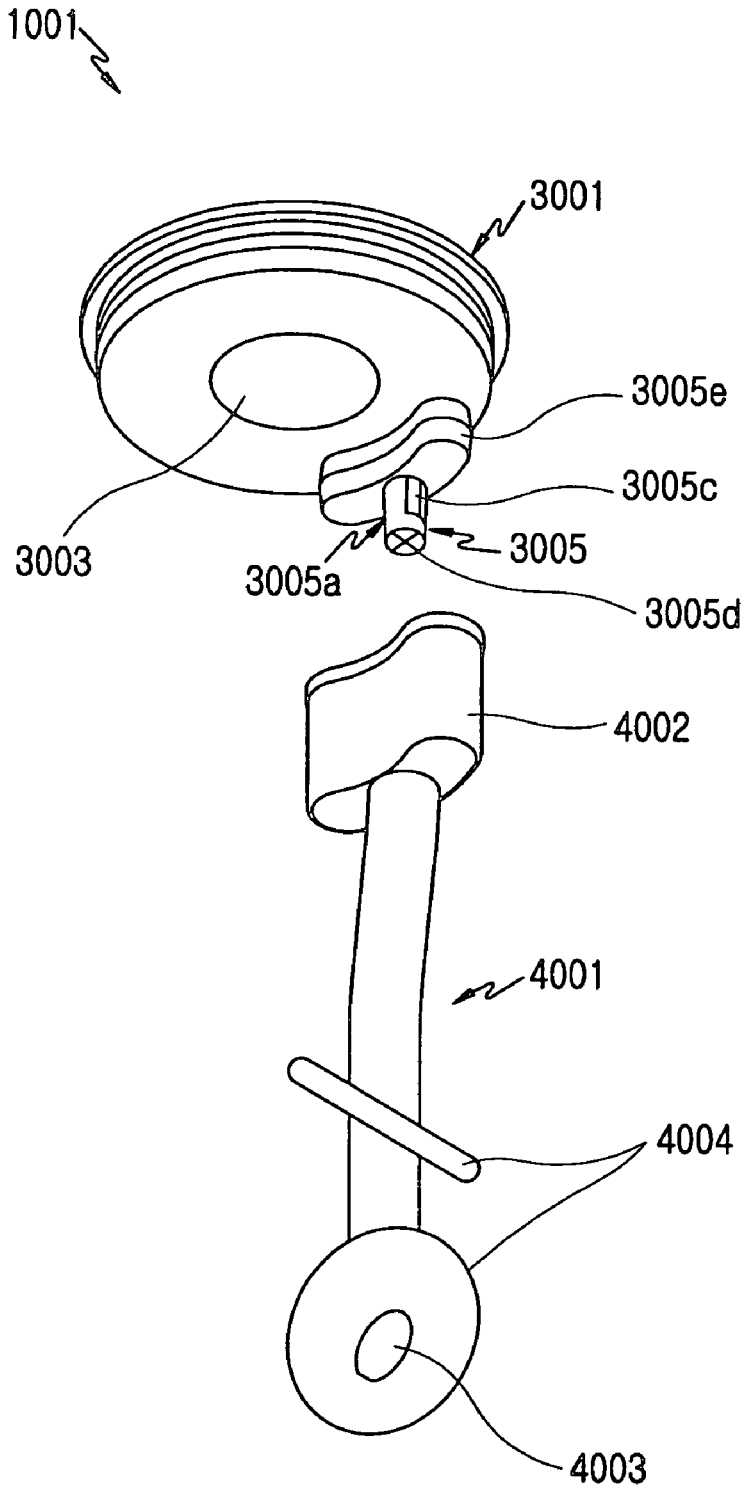
FIG. 13 is an exploded perspective view of the air venting apparatus before assembly according to the second embodiment of the present invention.
Figure 14:
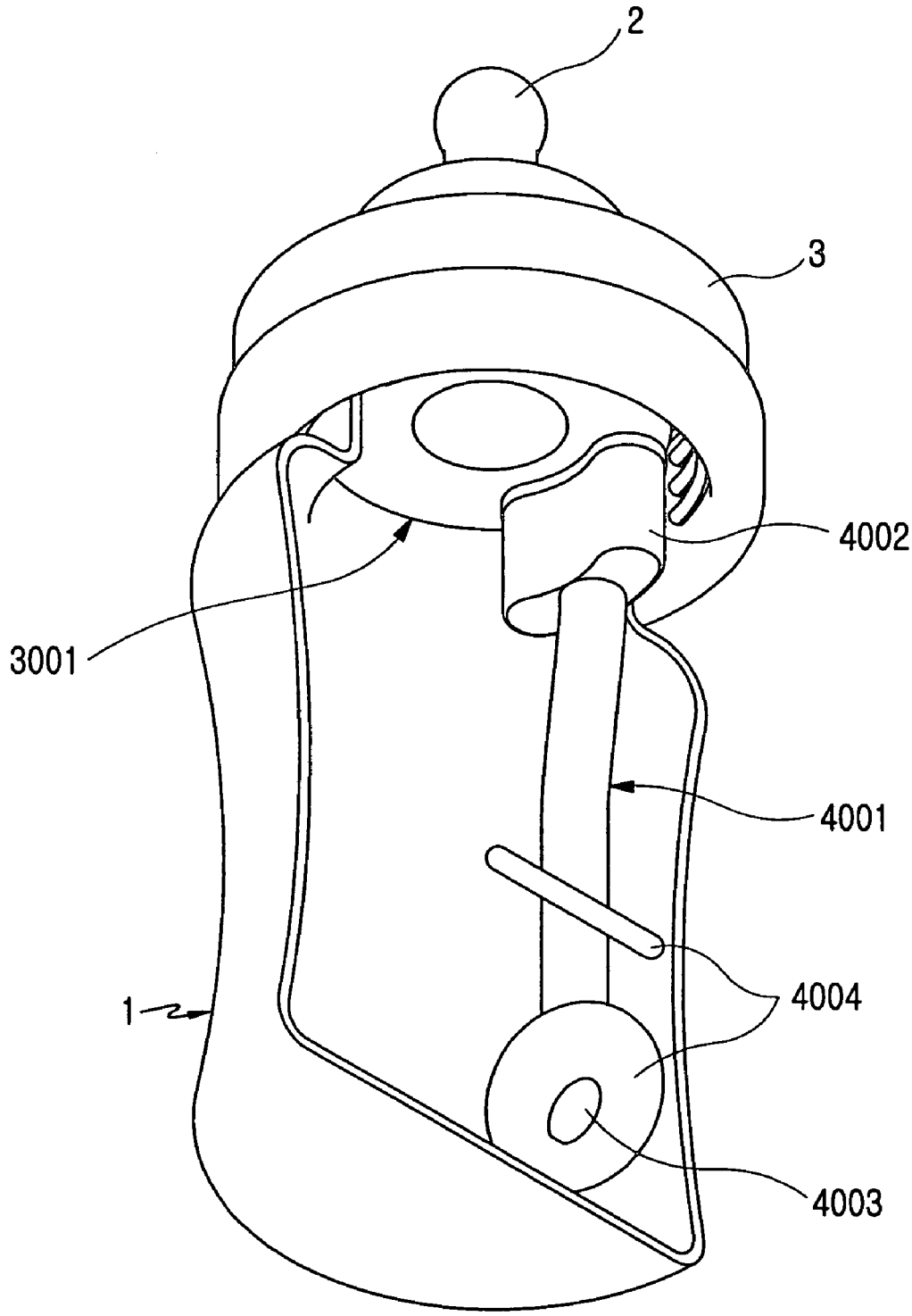
FIG. 14 is a sectional perspective view of the air venting apparatus assembled in the baby milk bottle according to the second embodiment of the present invention.

Referring to FIGS. 12 and 13, the milk bottle includes the bottle body 1 for filling milk therein, the soft teat 2 on top of the bottle body 1, for a baby to suck milk from, and the fixing frame 3 for fixing the soft teat 2 to the bottle to prevent milk leakage. As illustrated in FIGS. 13 and 14, an air venting apparatus 1001 is comprised of an air vent valve 3001 and a connection member 4001. The air vent valve 3001 is intervened between the top of the bottle body 1 and the base of the teat 2. The connection member 4001 is engaged with an air control valve 3005 formed on the bottom of the air vent valve 3001. The connection member 4001 is then inserted into the bottle body 1. Here, a slip preventing piece 3002 formed on the air vent valve 3001 is tightly in contact with the inner lower side surface of the teat 2.

Figure 15:
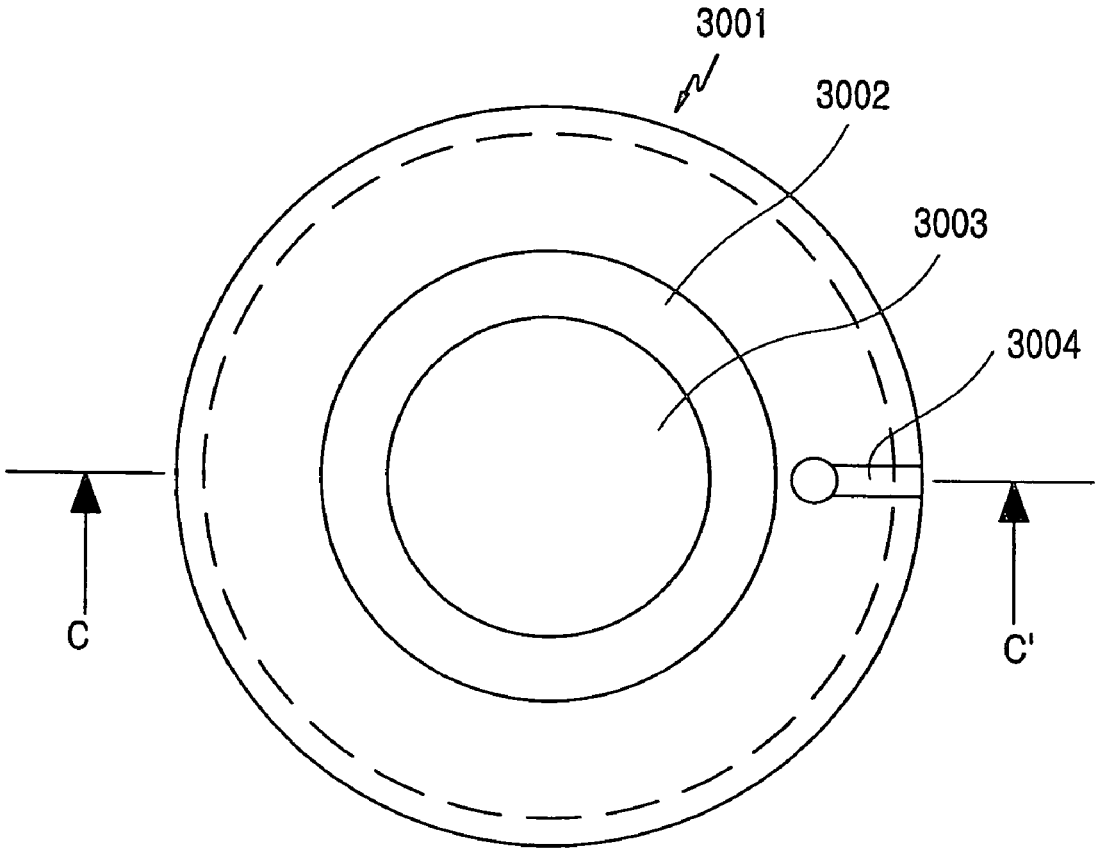
FIG. 15 is a plan view of an air vent valve in the air venting apparatus for the baby milk bottle according to the second embodiment of the present invention.
Figure 16:
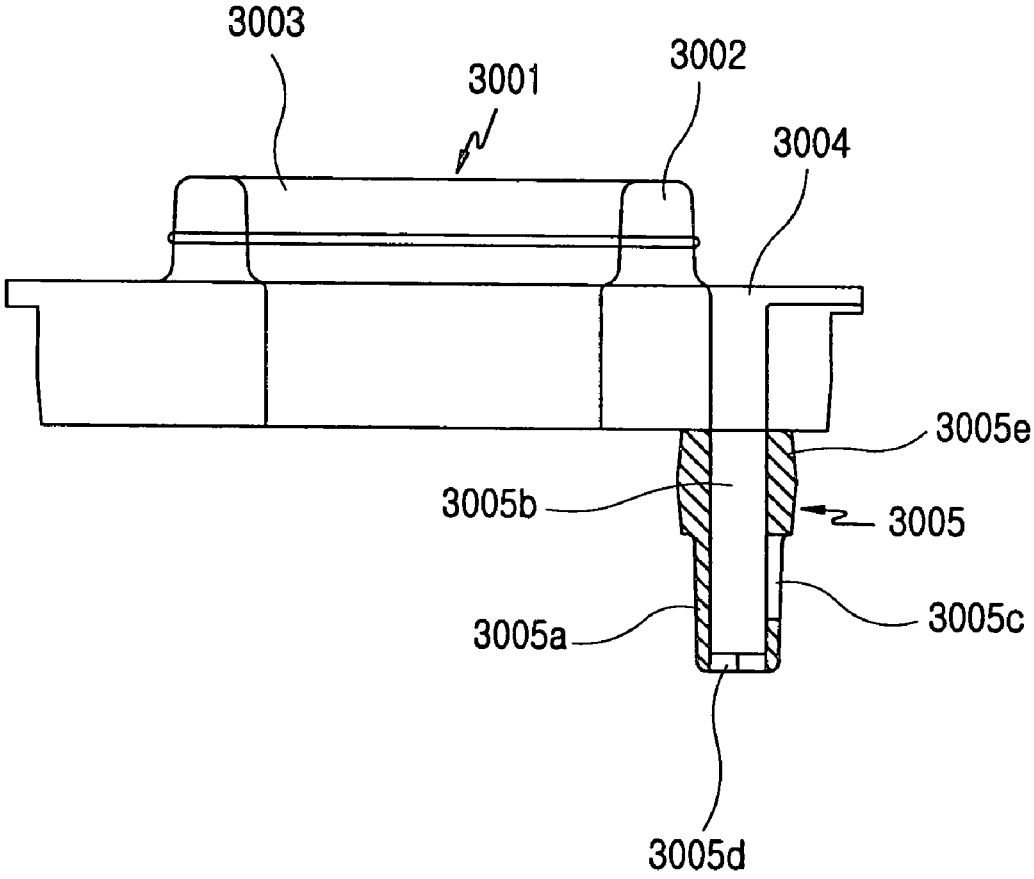
FIG. 16 is a sectional view of the air vent valve illustrated in FIG. 15, taken along line C–C'.

An air inlet groove 3004 is formed on the upper surface of the air vent valve 3001. Thus, external air is provided into the air vent valve 3001 through the air inlet groove 3004. Referring to FIGS. 15 and 16, a first non-return valve 3005*c* is formed in the air control valve 3005 to adjust the amount of the introduced air. Specifically, the first non-return valve 3005*c* is formed on the side surface of a control valve body 3005*a* to be opened outward from the control valve body 305*a*. Thus, the first non-return valve 3005*c* is opened outward from the control valve body 3005*a* and adjusts air flow, which was introduced from the air inlet groove 3004, into the bottle body 1. An engagement portion is formed on the bottom of the air control valve 3005 and forcedly engaged with a cap 4002 of the connection member 4001.

Figure 17:
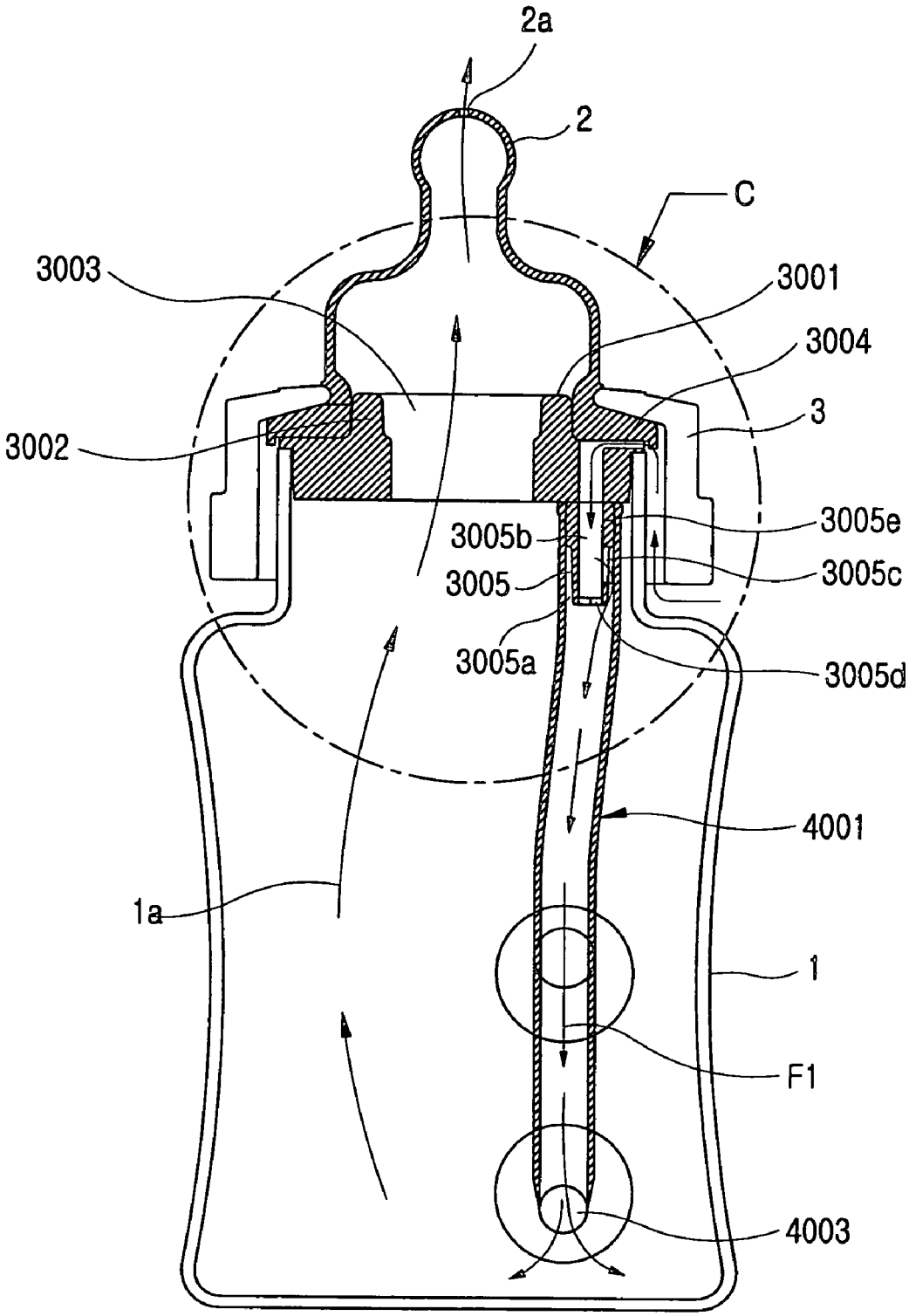
FIG. 17 is a side sectional view of the baby milk bottle incorporating the air venting apparatus with a first non-return valve opened in a air control valve according to the second embodiment of the present invention.
Figure 18:
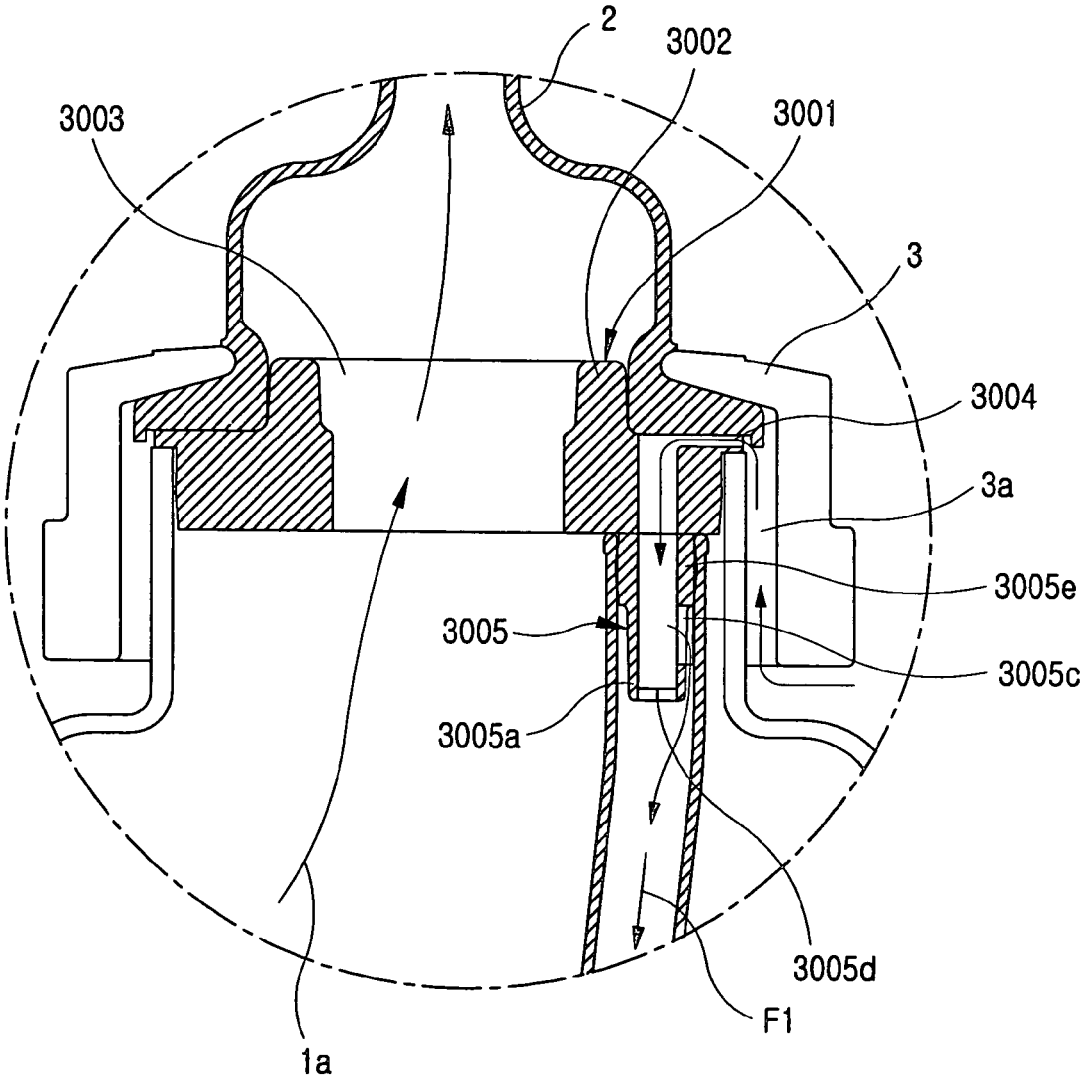
FIG. 18 is an enlarged view of a portion C in the baby milk bottle illustrated in FIG. 17.
Figure 19:
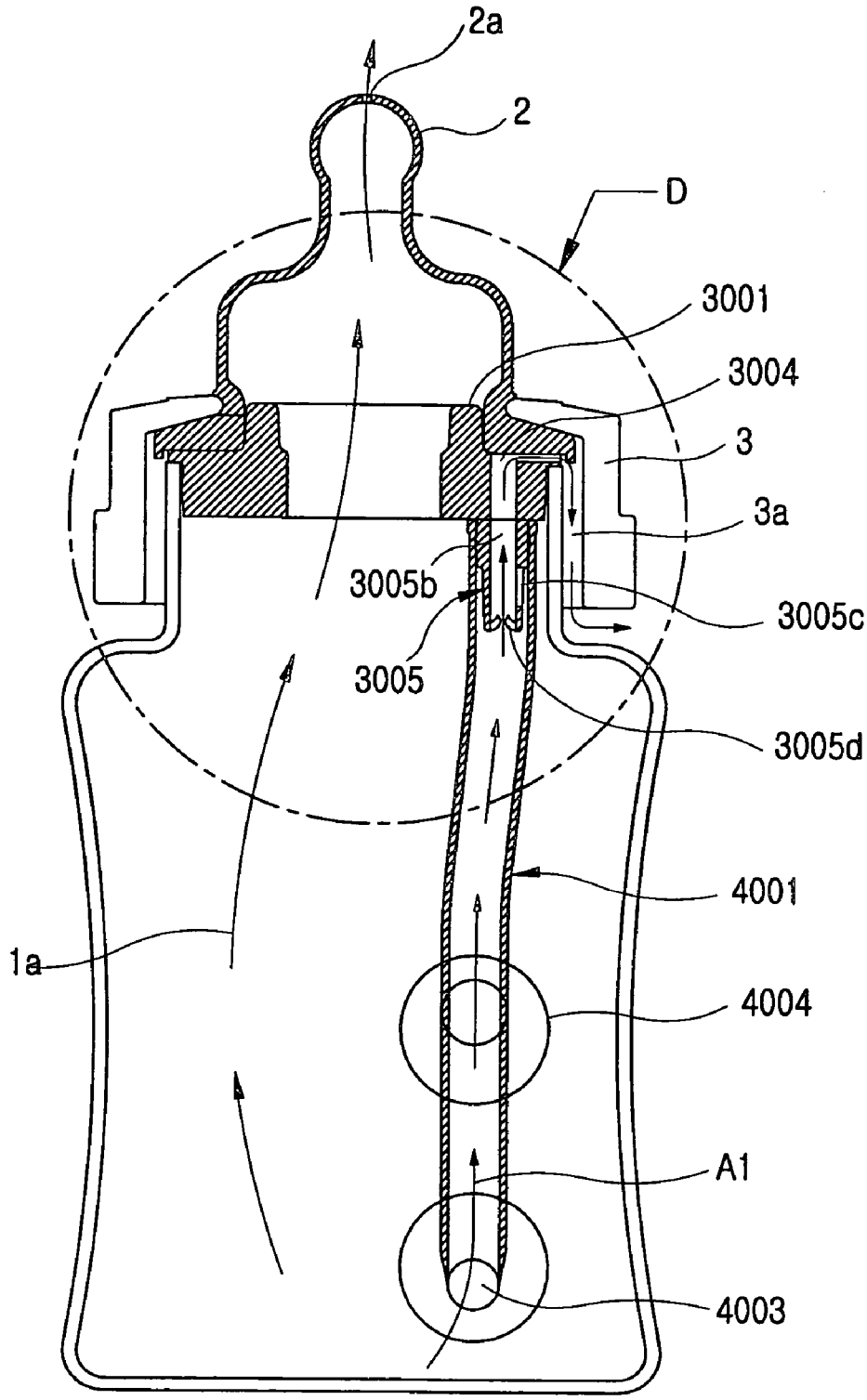
FIG. 19 is a side sectional view of the baby milk bottle incorporating the air venting apparatus with a second non-return valve opened in the air control valve according to the second embodiment of the present invention.
Figure 20:
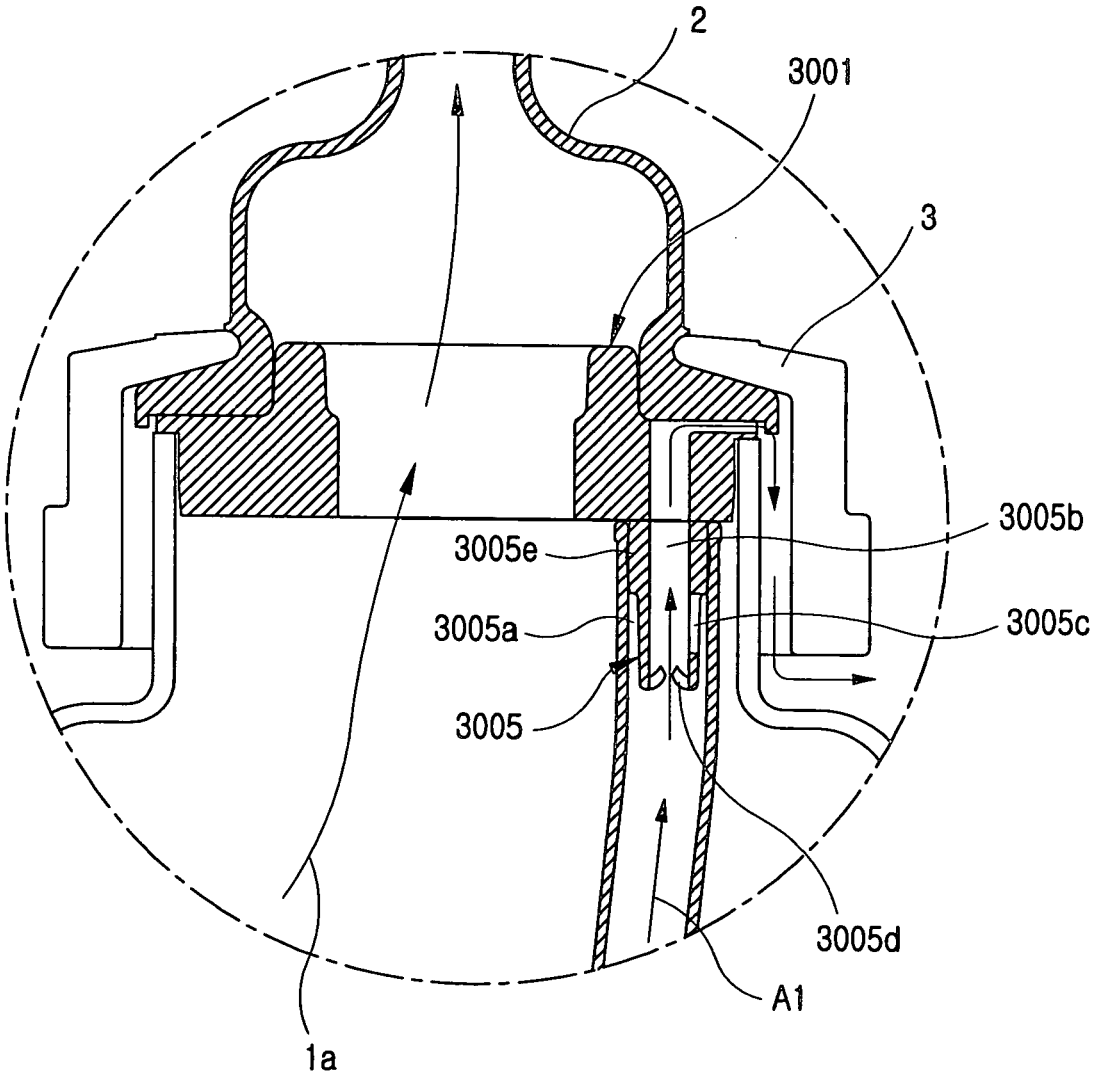
FIG. 20 is an enlarged view of a portion D in the baby milk bottle illustrated in FIG. 19.
Figure 21:
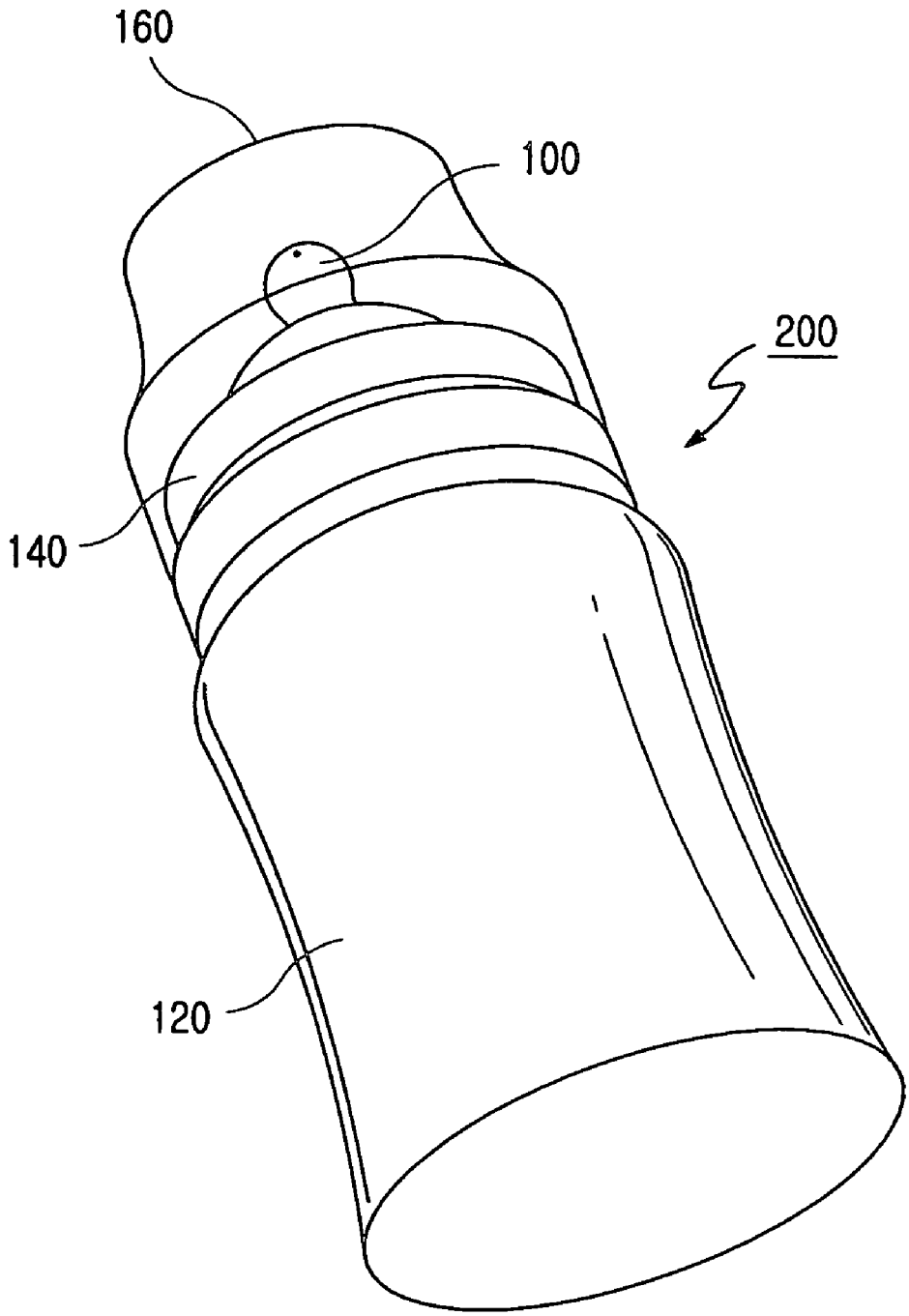
FIG. 21 is a perspective view of the exterior of a baby milk bottle having an air vent path, viewed from the bottom, according to a third embodiment of the present invention.
Figure 22:
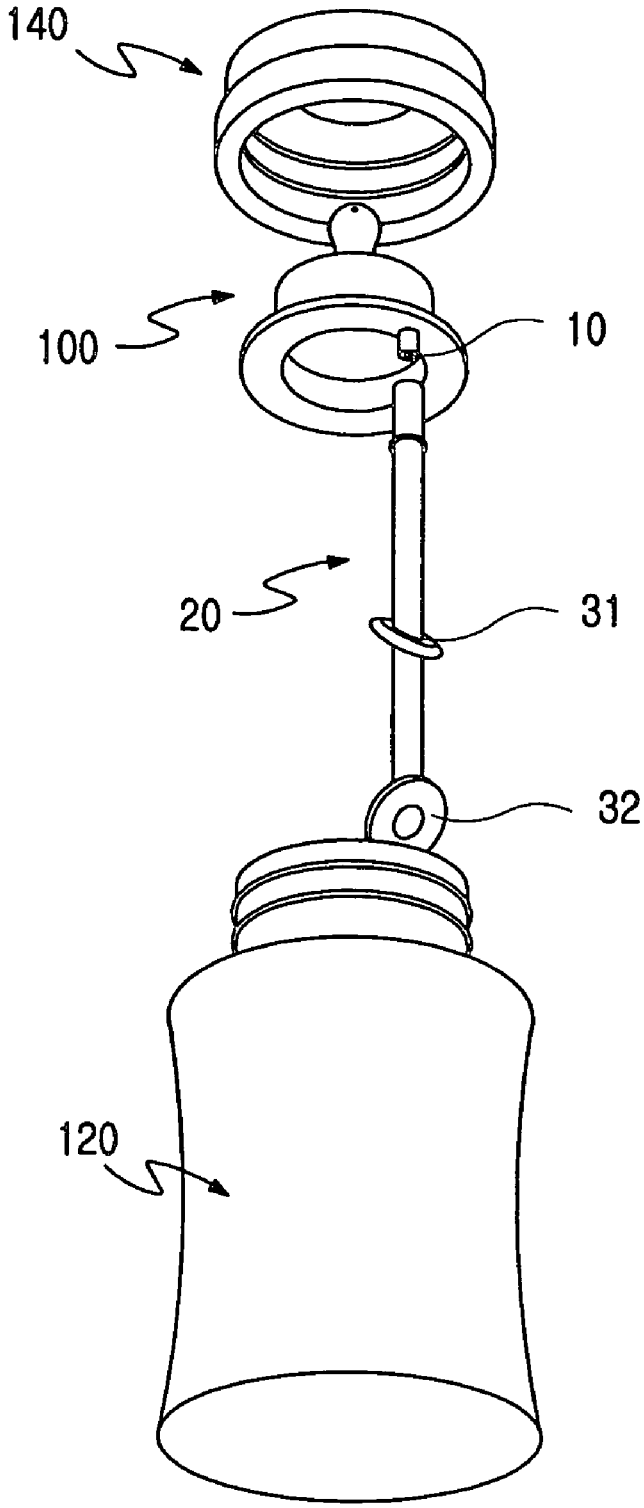
FIG. 22 is an exploded perspective view of the baby milk bottle having the air vent path according to the embodiment of the present invention.
Figure 23:
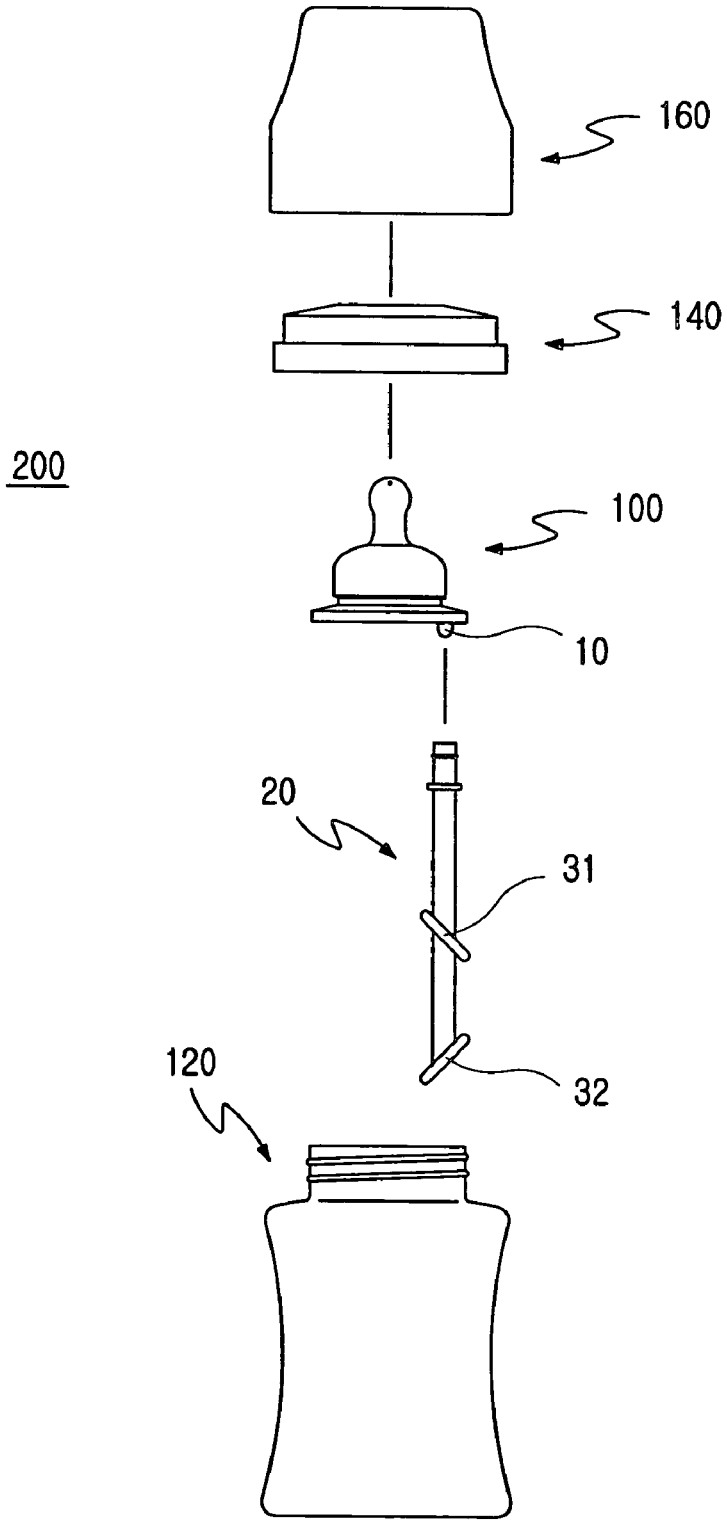
FIG. 23 is a front view of the baby milk bottle illustrated in FIG. 22.
Figure 24:
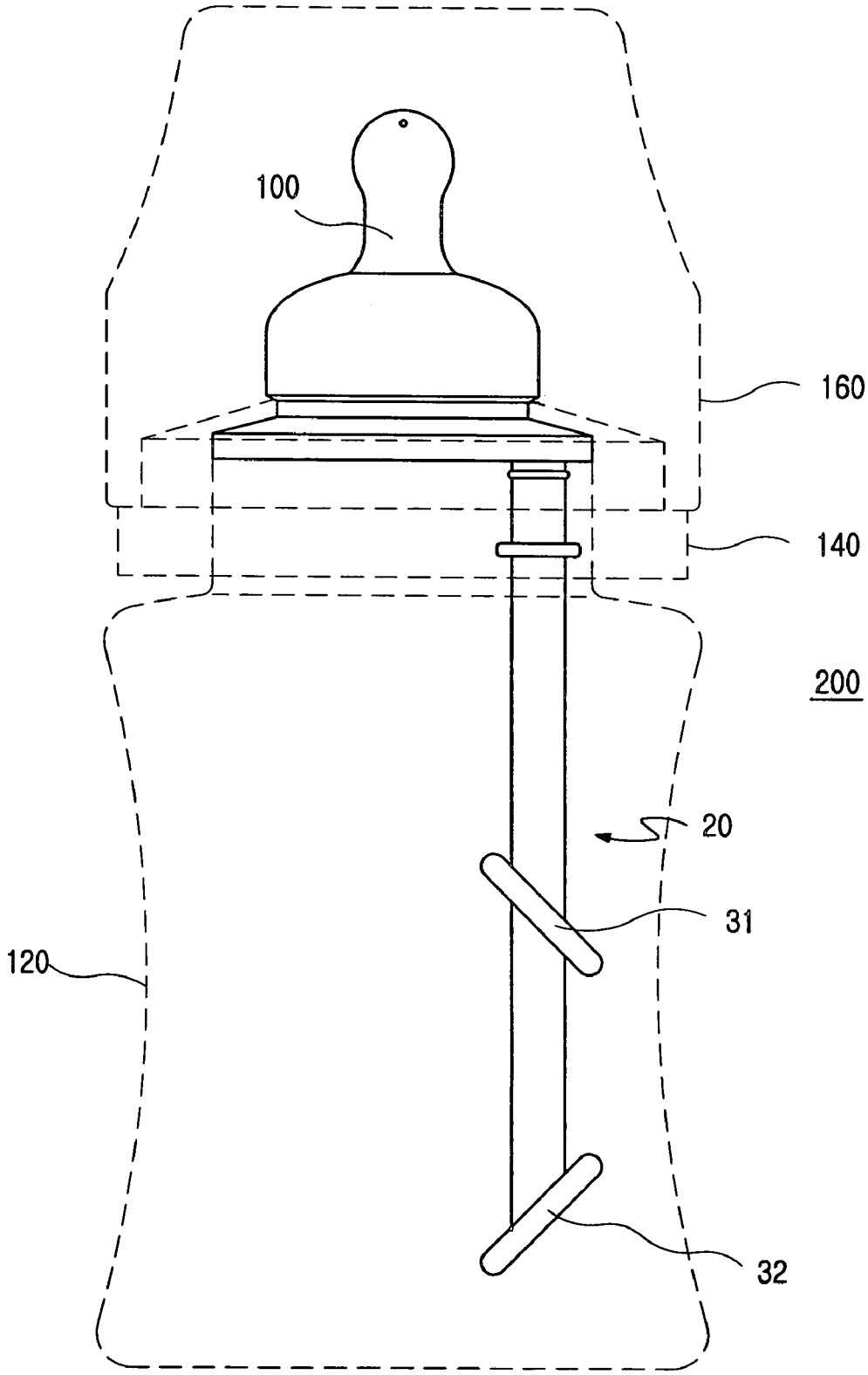
FIG. 24 is a front view of the baby milk bottle having an annular connection member installed in an air vent valve according to the third embodiment of the present invention.

Referring to FIGS. 17 and 18, external air controlled by the first non-return valve 3005*c* reaches inside the bottle body 1 through the connection member 4001. An air outlet hole 4003 is formed at a lower end of the connection member 4001, for providing the air controlled by the air control valve 3005 into the bottle body 1. To uniformly mix milk powder and water in the bottle body 1 in this state, at least one mixer 4004 is provided. The mixer 4004 helps uniform mixing of the powder and water when the bottle body 1 is shaken left and right or up and down. During the mixing, the gas A1 is generated from high-temperature milk under the control valve body 3005*a*, as illustrated in FIGS. 19 and 20. To discharge the gas A1 outside the bottle body 1, a second non-return valve 3005*d* is formed in the air control valve 3005. The second non-return valve 3005*d* is opened inward in the control valve body 3005*a* as the pressure of the gas A1 increases. Hence, the gas A1 comes in the control valve body 3005*a*, passes through a hole 3005*b* formed in the upper portion of the control valve body 3005*a*, and goes out through the air inlet groove 3004 communicating with the hole 3005*b* and an air vent path 3*a* between the bottle body 1 and the fixing frame 3. When a baby then sucks the teat 2, the suction leads a flow of the milk 1*a* into the baby's mouth through the hole 2*a* at the tip of the teat 2. The air venting apparatus 1001 introduces the external air F1 into the bottle body 1, controls the amount of the air F1, mixes the air F1 with the milk 1*a* in the bottle body 1, and discharges the mixture through the hole 2*a* of the teat 2. As illustrated in FIGS. 17 and 19, since a milk outlet hole 3003 is formed at the center of the air vent valve 3001, the milk 1*a* moves to the teat 2 through the milk outlet hole 3003. Thus, the baby can suck the milk 1*a* out of the milk bottle comfortably and steadily.

To clean the bottle body 1 after the baby sucks up the milk 1*a*, the fixing frame 3 is turned to be loosened from the top of the bottle body 1 and removed together with the teat 2 from the bottle body 1. The air venting apparatus 1000 is also removed from the bottle body 1. The connection member 4001 is removed from the air vent valve 3001. Then the separated bottle body 1, air vent valve 3001, and connection member 4001 are cleaned.

Referring to FIGS. 21 to 25, a baby milk bottle 200 according to a third embodiment of the present invention includes a teat 100, a bottle 120 for containing milk, a fixing frame 140 for fixing the teat 100 to the bottle 120 without milk leakage, an air vent valve 10 formed on the bottom 104 of the teat 100, for introducing external air into the bottle 120, and an annular connection member 20 for leading the introduced air to the vicinity of the bottom of the bottle 120. The connection member 20 has mixers 31 and 32.

The teat 100 is divided into a teat body 102 and the bottom 104 to be engaged with the bottle 120 by means of the fixing frame 140. A hole 106 of a predetermined shape is formed on top of the teat 100. The hole 106 has a valve 108 such that outward milk flow from the bottle 120 is easy but inward milk flow into the bottle 120 is difficult. The air vent valve 10 extends downward from a predetermined position of the bottom 104 of the teat 100 and has a first hole 11 formed downward from the bottom 104 of the teat 100, for introducing air inside the bottle 120. The air vent valve 10 further includes a second hole 12 and a valve 13 convex downward at its end. The valve 13 facilitates air intake into the bottle 120, while it makes air outtake from the bottle 120 difficult. The annular connection member 20 fits around the air vent valve 10, extending lengthwise to the vicinity of the bottom of the bottle 120. The connection member 20 functions to lead the introduced air toward the bottom of the bottle 120. Preferably, the connection member 20 has a plurality of mixers 31 and 32 along its length. The mixers 31 and 32 are circular plates and installed to the connection member 20, tilted to a predetermined angle. The shape of the mixers 31 and 32 is not confined to circle. Therefore, they can be of any other shape such as square, triangle, or regular hexagon. Also, the mixers 31 and 32 can be installed horizontally without inclination. The mixers 31 and 32 are integrally formed of plastic together with the connection member 20 by injection molding. While two mixers are shown, one or mixers can be installed. The mixers 31 and 32 mix milk powder with water uniformly when the bottle 120 is shaken up and down or left and right. Because the inventive baby milk bottle is provided with the air vent valve and the annular connection member, air bubbles are suppressed and thus destruction of nutrients is minimized.

Figure 25:
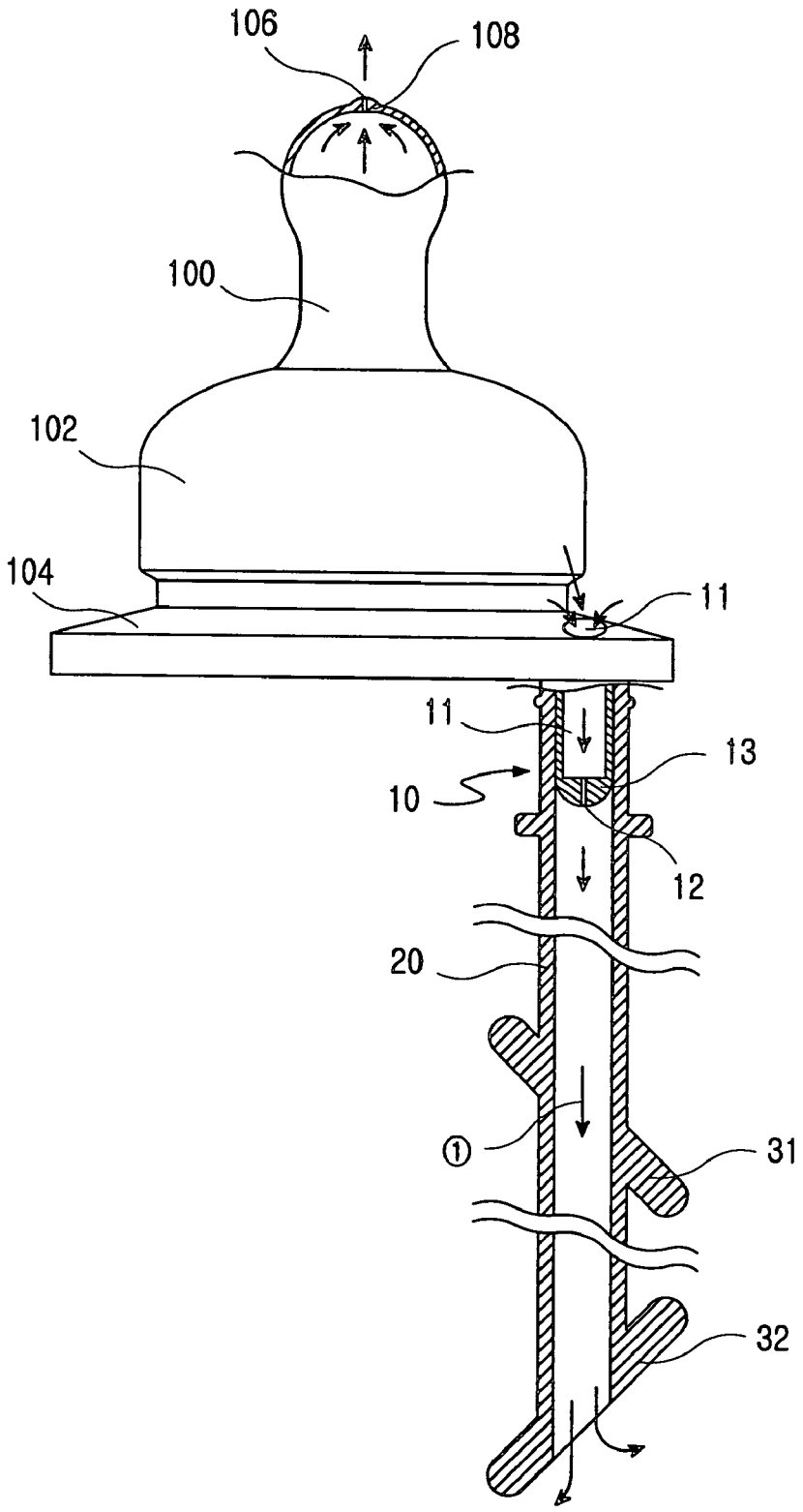
FIG. 25 is partial cut front view of the air vent valve according to the third embodiment of the present invention.

When the baby sucks the teat 100 with the bottle 120 upside down, air is introduced into the air vent valve 10 through the first hole 11 and reaches inside the bottle 120 via the second hole 12 and the connection member 20, as illustrated in FIG. 25. For reference, the baby milk bottle 200 according to the first embodiment of the present invention is used upside down to feed milk to the baby. While not shown, the second hole 12 is preferably cross-shaped. Yet, it can be shaped like Y, star, or any other shape.

Now, a description will be made below of a baby milk bottle which in a normal state feeds milk to the baby. The "normal state" is defined as upright positioning of the baby milk bottle with the teat 100 upward and the bottle 120 downward.

Figure 26:
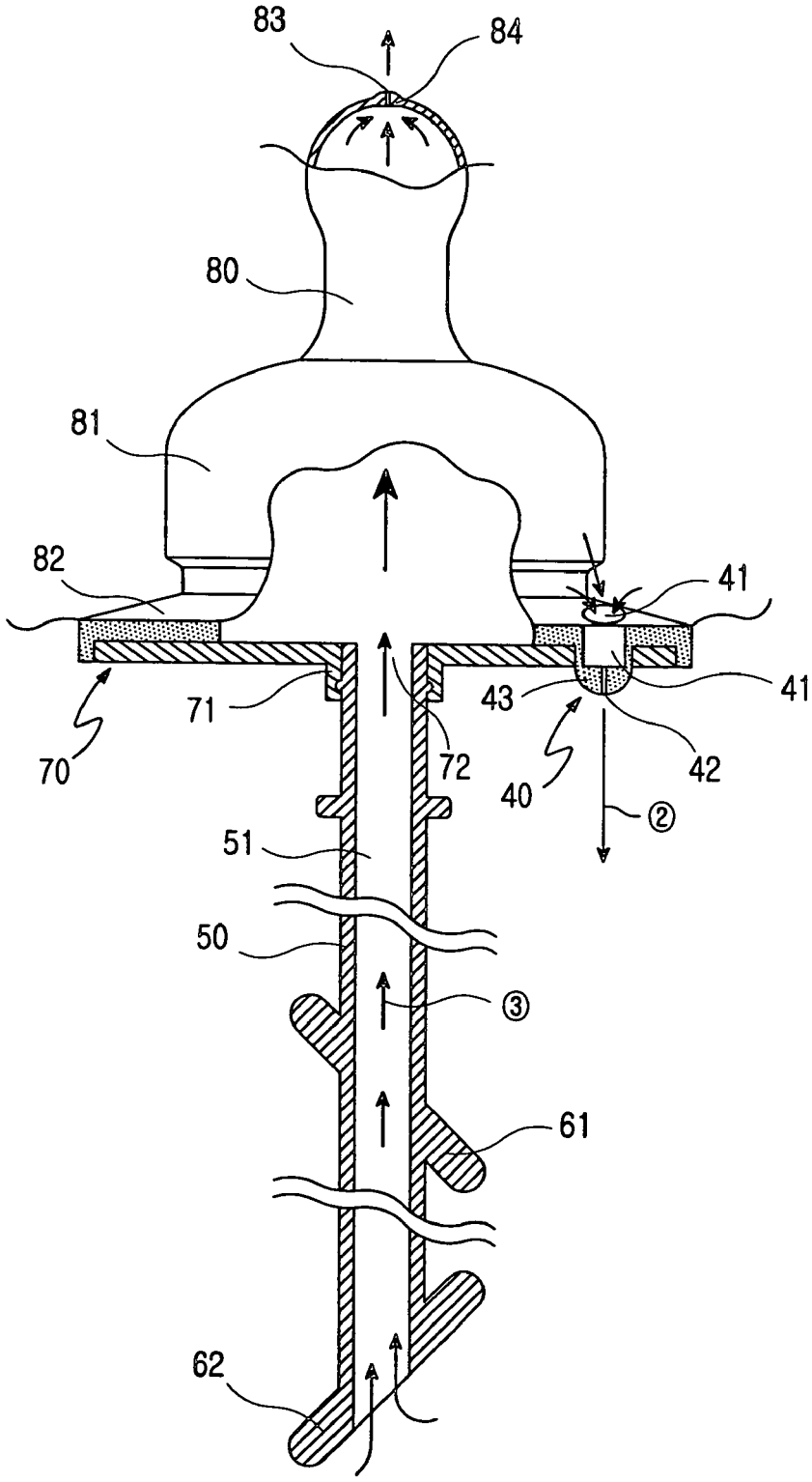
FIG. 26 is a partial cut front view of an air vent valve and an annular connection member according to a fourth embodiment of the present invention.

FIG. 26 illustrates a baby milk bottle according to a fourth embodiment of the present invention. Notably, the baby can drink milk out of a teat 80 with the bottle in a normal state. Referring to FIG. 26, the milk bottle is comprised of an air vent valve 40, an annular connection member 50 extended to the vicinity of the bottle, for providing a milk suction path, and a fixing member 70 for fixing the annular connection member 50 to the teat 80, particularly to its bottom 82. The connection member 50 can be fixed to any portion of the bottom 82 of the teat 80, while it is shown at the center of the teat bottom 82.

The air vent valve 40 extends downward from a predetermined position of the bottom 82 of the teat 80 and has a first hole 41 for introducing eternal air into the bottle. The air vent valve 40 further includes a second hole 42 through which the air passes and a valve 43 convex downward, under the first hole 41. In view of the downward convex shape, the valve 43 facilitates air venting in an arrow direction b, while it suppresses air venting in the reverse direction. The teat 80 including the bottom 82 is formed of silicon harmless to the body. Due to the excellent elasticity of silicon, the valve 43 can also be formed of silicon.

The connection member 50 is a rod extending from the fixing member 70 to the vicinity of the bottom of the bottle. It provides a milk outlet path through its inner space 51. The connection member 50 has mixers 61 and 62. At least one mixer is provided along the length of the connection member. For more uniform mixing, they are formed as circular plates. They are installed tilted to a predetermined angle, for improving mixing uniformness. Yet, the mixers 61 and 62 are not confined to circle. Thus, they can be of any other shape such as square, triangle, or regular hexagon. Also, the mixers 61 and 62 can be installed horizontally without inclination.

The fixing member 70 has an engaging portion 71 and a second hole 72 at its center, for engagement with the engagement portion 71. The fixing member 70 supports the air vent valve 40 at a predetermined position. For reference, the arrow direction b indicates an external air venting direction, and an arrow direction c indicates a milk suction direction. When the baby sucks the teat 80 with some pressure, milk flows out through the connection member 50, and air is introduced into the bottle with its amount adjusted via the air vent valve 40 at the same time. A valve 84 is provide to a hole 83 at the tip of the teat 80 to allow milk suction only in one direction. Therefore, reverse milk flow from the baby's mouth to the bottle is prevented.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An air venting apparatus for a milk bottle having a soft teat for a baby to suck, a bottle for containing milk, and a fixing frame for fixing the soft teat to the bottle without leakage, the apparatus comprising:

an air vent valve extending downward from a predetermined position of the bottom of the teat and having a first extending hole for communicating external air with the inside of the bottle, a second extending hole coupled to the first hole, for receiving the air from the first hole, and a valve that convexes downward and surrounds the second extending hole; and an annular connection member extending downward from the air vent valve to the vicinity of the bottom of the bottle, for providing controlled air toward bottom of the bottle.

2. The air venting apparatus of claim 1, wherein the annular connection member comprises a first mixer for uniformly mixing milk powder with water.

3. The air venting apparatus of claim 2, wherein the first mixer is shaped like a circular plate titled to a predetermined first angle and integrally formed lengthwise with the annular connection member.

* * * * *